US005096204A

United States Patent [19]

Lippman

[11] Patent Number: 5,096,204

[45] Date of Patent: Mar. 17, 1992

[54] THREE-DIMENSIONAL BOOK OR GAME BOARD STRUCTURE

[76] Inventor: Peter J. H. Lippman, Montgomery Hollow Rd. So., Roxbury, N.Y. 12474

[21] Appl. No.: 553,696

[22] Filed: Jul. 13, 1990

[51] Int. Cl.[5] ..... A63F 3/00; B42D 1/00; A63H 33/38

[52] U.S. Cl. ..... 273/285; 281/15.1; 446/478; 273/287

[58] Field of Search ..... 273/285, 287; 281/15.1; 40/538; 446/487, 488, 478, 73, 74, 76

[56] References Cited

U.S. PATENT DOCUMENTS

| | | | |
|---|---|---|---|
| Re. 26,395 | 5/1968 | Schneider | 40/530 |
| 395,953 | 2/1889 | Clark | 446/487 |
| 510,599 | 12/1893 | Harrison | 40/530 |
| 969,309 | 9/1910 | Tuck et al. | 40/530 |
| 1,885,076 | 10/1932 | Bustamante | 281/29 |
| 2,117,946 | 5/1938 | Cresswell | 281/15.1 |
| 2,179,172 | 11/1939 | Bonnaire | 283/62 |
| 2,205,692 | 6/1940 | Johnson et al. | 281/29 |
| 2,264,119 | 11/1941 | Lichter | 283/61 |
| 2,377,968 | 12/1945 | Richman | 283/62 |
| 2,473,352 | 6/1949 | Zimmerman | 283/62 |
| 2,546,878 | 3/1951 | Townley | 40/530 |
| 2,556,798 | 6/1951 | Concordet | 40/530 |
| 3,440,750 | 4/1969 | Toth et al. | 40/530 |
| 3,456,380 | 7/1969 | Cameron | 281/15.1 |
| 3,738,686 | 6/1973 | Morse | 283/62 |
| 3,800,442 | 4/1974 | Petrocelli | 446/487 |
| 3,868,283 | 2/1975 | Scheyer | 40/530 |
| 4,280,241 | 7/1981 | Pfaff | 11/1 R |
| 4,349,797 | 9/1983 | Cole | 428/9 |
| 4,538,833 | 9/1985 | Trikilis | 283/62 |
| 4,597,743 | 7/1986 | Becker | 446/71 |
| 4,819,963 | 4/1989 | Wolski | 281/15.1 |
| 4,853,994 | 8/1989 | Ekstein | 5/437 |
| 4,909,542 | 3/1990 | Marks | 281/15.1 |

*Primary Examiner*—Benjamin Layno
*Attorney, Agent, or Firm*—Kenton L. Freudenberg; Maxwell C. Freudenberg

[57] ABSTRACT

A construction of book or game board with an open and a closed configuration, made of individual leaves in which the leaves have substantial thickness and in which the outline shape of any individual leaf is defined in essentially two dimensions. The two dimensional shape or size of the leaves varies from one leaf to another so that the closed book is in the form of a distinct three-dimensional sculpture with a recognizable shape. The leaves may be foldably connected so that in the open configuration of the structure, the leaves are capable of lying in a single plane.

64 Claims, 27 Drawing Sheets

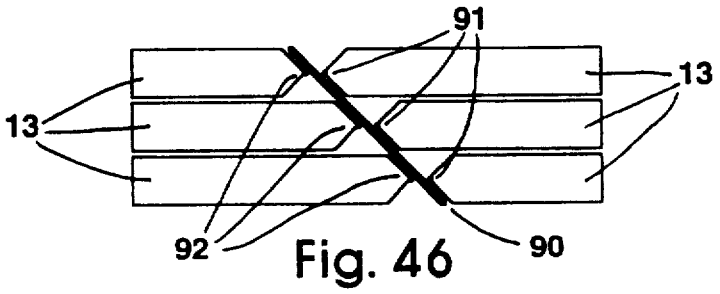
Fig. 46
Fig. 47
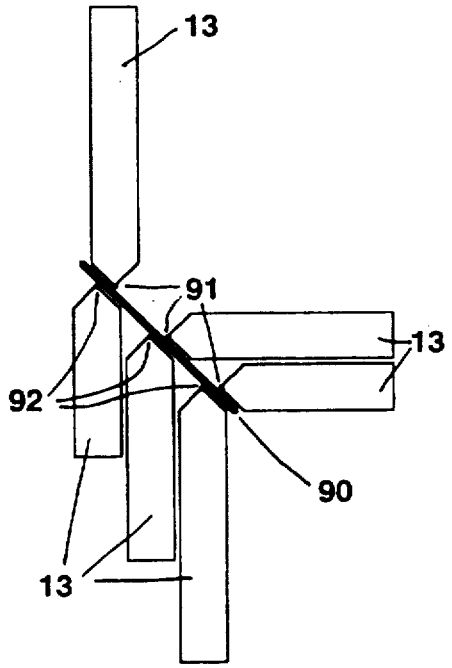
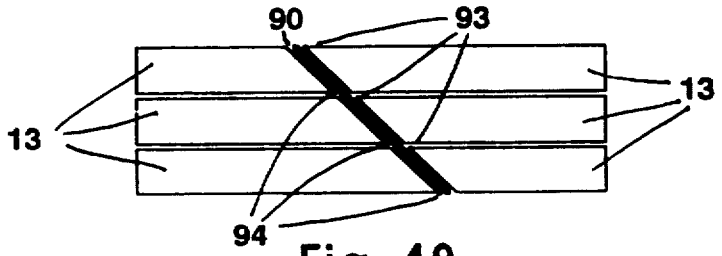
Fig. 48

THREE-DIMENSIONAL BOOK OR GAME BOARD STRUCTURE

BACKGROUND OF THE INVENTION

Prior art in the field of books, and particularly children's books, has commonly used leaves of a substantial thickness so that a book of relatively few pages would have a substantial total thickness. This concept has been extended to the point of using a number of identically shaped pages to form a book which has a general outline of an object, such as a human form, or of an article, for instance a truck, which is visible as such from one primary point or direction of view. The present invention provides for a book with contoured leaves of a variety of different shapes or sizes so that the assembled book provides a three-dimensional sculpture and has a shape which is recognizable as a three-dimensional object or unique artistic form from virtually any angle of view. Additionally, by varying the method by which the book is assembled, the leaves of the opened book structure can be used to form a flat two dimensional structure which can be arranged in the form of a board upon which a game can be played or as a poster or other two dimensional structure having a different artistic or recognizable form. The three-dimensional structure of the closed book is further capable of being provided with an internal recess which provides an enclosed compartment for containing items such as game pieces or which may serve as a packaging container for goods.

Throughout this specification the term three-dimensional structure as applied to this invention is intended to refer to a structure forming a sculpture in the round. As will be seen from the following description of the invention, the leaves of the book-like structures described herein are preferably of substantial thickness and the many combined leaves in a book-like structure together are of substantial thickness whereby the smaller dimension of this latter thickness or of the width and breadth dimensions of the leaves of the structure, normal to the direction of thickness, will be at least a very substantial proportion of the next larger of the other two of these three dimensions. For a three-dimensional structure wherein the leaves are not all essentially parallel, the three dimensions to be compared for such proportions would be length, width and height. For example this proportion of the smallest dimension to the next larger of the other two dimensions is preferably at least 50 percent. As defined in Webster's Third New International Dictionary (Unabridged), the term "in the round" means "in full sculptured form unattached to a background". It is freestanding as distinguished from relief. Relief on the other hand is defined as a mode of sculpture in which forms and figures are distinguished from a surrounding plane surface.

Reference herein to three-dimensional configurations is intended to refer to three-dimensional objects which are "sculpture in the round". Applicant's three-dimensional objects are intended to be freestanding objects and the three-dimensional configuration of the invention is recognizable from at least all sides and the top and even in the case of an object which can be raised or tilted to see the bottom, or is supported on a pedestal or leg structure, from even the underside of the object.

The structures made according to the present invention are also intended to be distinguished from sculpture in high relief which is merely sculpture in which half or more of the natural dimensions of the form project from a surface and are integral with that surface.

Although the three-dimensional configurations of the present invention may rest on a surface, they are not extensions nor an integral part of a surface, are not properly defined as being objects in basrelief or high relief and are distinct therefrom.

SUMMARY OF THE INVENTION

The present invention provides a book-like structure comprising leaves or pages, typically made of relatively thick material, which are individually shaped or sized so that the pages have varying outlines, most of which have flat, readable or viewable surfaces which each give a generally two dimensional graphical depiction or provide readable indicia when the book is in its various opened or extended configuration. The leaves or layers combine to create a structure with a sculptured primary distinct compact three-dimensional configuration or shape when the book is closed and most of the flat surfaces are hidden from view. As a simple example, each leaf could depict a scene within a room of a house while the closed book would create a small three-dimensional model of the house. Other examples of three-dimensional structures which are readily created using the structure of the present invention are shapes relating to architecture, animals, vehicles, tools, trees, plants and people.

Also provided is a three-dimensional structure formed by the folding together of two dimensional leaves, the leaves being oriented in such a manner that, when unfolded, they lie in a single plane forming a flat surface. These planar forms can also take the form of outlining a recognizable shape, such as an animal. Because of the planar orientation of the unfolded structure, such an embodiment is adaptable for use for other purposes such as a flat board for playing a board game or as a display poster.

When used as a game board the structure of the present invention provides the advantage of folding into a more convenient shape for storage than a traditional game board which typically folds in half or quarters and requires a relatively large amount of surface area for its storage. It also allows the board to be provided with a recognizable shape in its closed position so that the shape correlates to an underlying theme of the game for which the board is used. For example the board could fold into the shape of a castle in a game with a theme and/or characters relating to royalty and/or hidden treasure. In contrast, the shape of a traditional game board also has little visual appeal in its folded or closed state.

Additionally, several superposed individual leaves or lamina of a three-dimensional structure of the present invention can be provided with cutouts which align when the structure is in its compact closed configuration so that the aligned cutouts provide a recess or compartment within the closed structure. This compartment allows the three dimensional structure to be used for containment or storage or as a packaging container for any object. An example of such a use would be to store playing pieces or other game related accessories within a compartment inside the compact closed structure of a game board as described above.

It is an object of the present invention to provide a book structure which provides a recognizable three-dimensional sculptured shape when in its closed configuration.

It is another object of the present invention to provide a book structure with a three-dimensional sculptured shape when in its closed configuration wherein the closed shape provides an internal enclosed and concealed storage recess.

It is another object of the present invention to provide a planar game board which is capable of being stored in a package far more compact than a normal or typical game board.

It is another object of the present invention to provide a planar game board which is capable of being folded into a compact three-dimensional structure which provides an internal storage recess.

It is another object of the present invention to provide a planar game board or poster-like structure which is capable of providing a three-dimensional sculptured shape in its closed configuration.

Another object of the invention is to provide a sculptured three-dimensional shape made up of a plurality of superposed multi-faceted interconnected leaves, layers or lamina structures in relatively parallel or perpendicular orientations and relatively movable with respect to one another by hinging, swinging or displacing each to expose the faces of the structures, which faces may contain printed information.

It is a further object of the present invention to provide a book or game board structure with a shape which creates an enhanced visual appeal when in its closed configuration.

Another object of the invention is to provide a book-like structure with a sculptured or shaped exterior which is capable of having multiple leaves of printed or graphical information and which also serves as a container or package.

The invention provides great latitude for sculpturing all sides of a sculpture in the round since hinges or connecting portions of adjacent connected edges of leaves may be of short length in the direction along those edges as compared to the lengths of those leaves in that direction whereby those edges may be significantly sculptured.

DESCRIPTION OF THE DRAWINGS

FIG. 46 shows an embodiment having multiple closed positions and an internal spine which is oriented at a skewed angle to the planes of the leaves, which are parallel in their closed positions and are shown in one such closed position.

FIG. 47 shows the embodiment of FIG. 46 with some leaves in an open position to expose surfaces upon which printed information may be displayed while other leaves are shown are in a second closed position.

FIG. 48 shows an alternative of the embodiment of FIG. 46 which avoids any groove on the exterior surfaces at the hinge points.

DESCRIPTION OF THE PREFERRED EMBODIMENT

Figure 1:
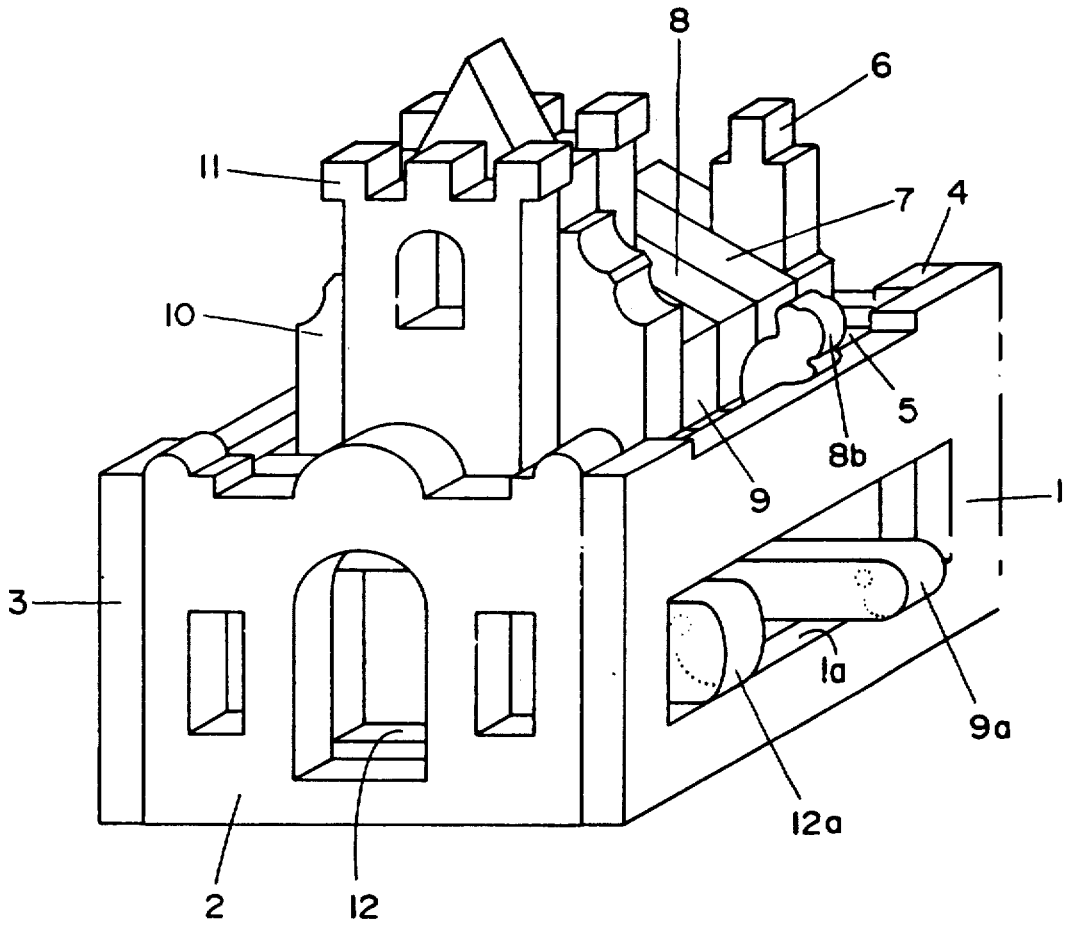
FIG. 1 is a perspective view of the closed three-dimensional book of the preferred embodiment with leaves foldably connected utilizing a fan-fold method.
Figure 2:
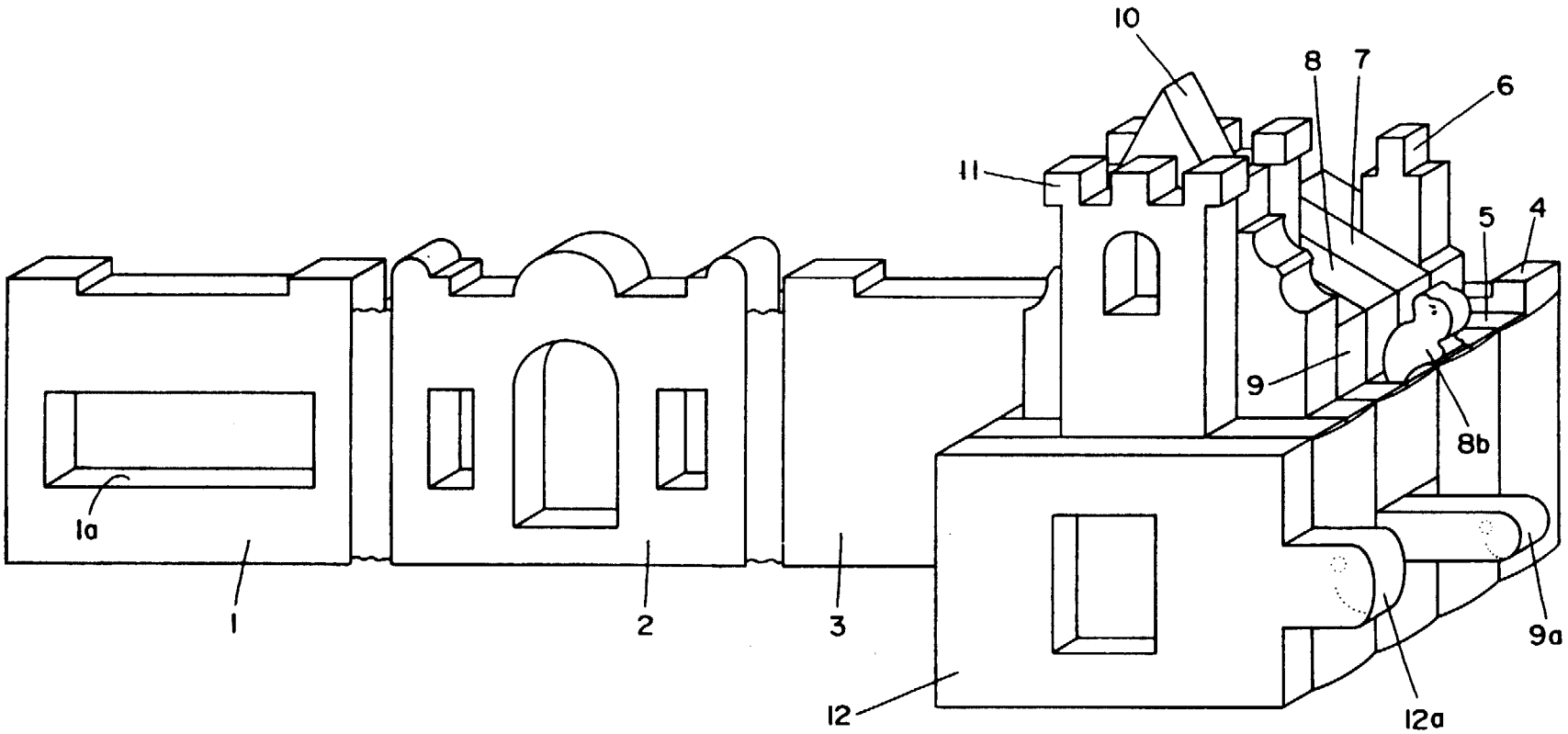
FIG. 2 is a perspective view of the partially opened book structure of FIG. 1.

The book-like structure of the preferred embodiment which forms a sculpture in the round is constructed of interconnected individual leaves 1 through 12 of varying size or shape and folded together by fan-folding so as to be capable of assuming varied shapes including a closed compact three dimensional shape as shown in FIG. 1 and open extended shapes shown in FIGS. 2–6.

Figure 11:
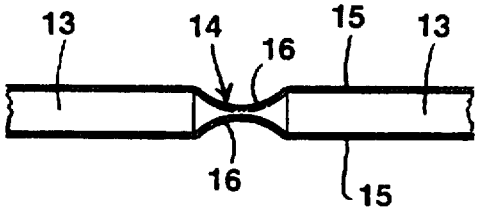
FIG. 11 is a partial cross section showing detail of a flexible web connection between leaves in a fan-fold structure when opened flat.

As shown in greater detail in FIG. 11, each leaf 13 is made of relatively thick and relatively rigid cardboard material covered with and held together at a hinged joint 14 by a paper 15 or other thin flexible backing or cover material which provides at each face of the hinge joint a flexible connecting web 16 between edges of the leaves. Elsewhere in the specification and drawings the numeral 13 is used to designate a leaf without limitation as to how its surface is coated or as to what indicia appears thereon.

Figure 5:
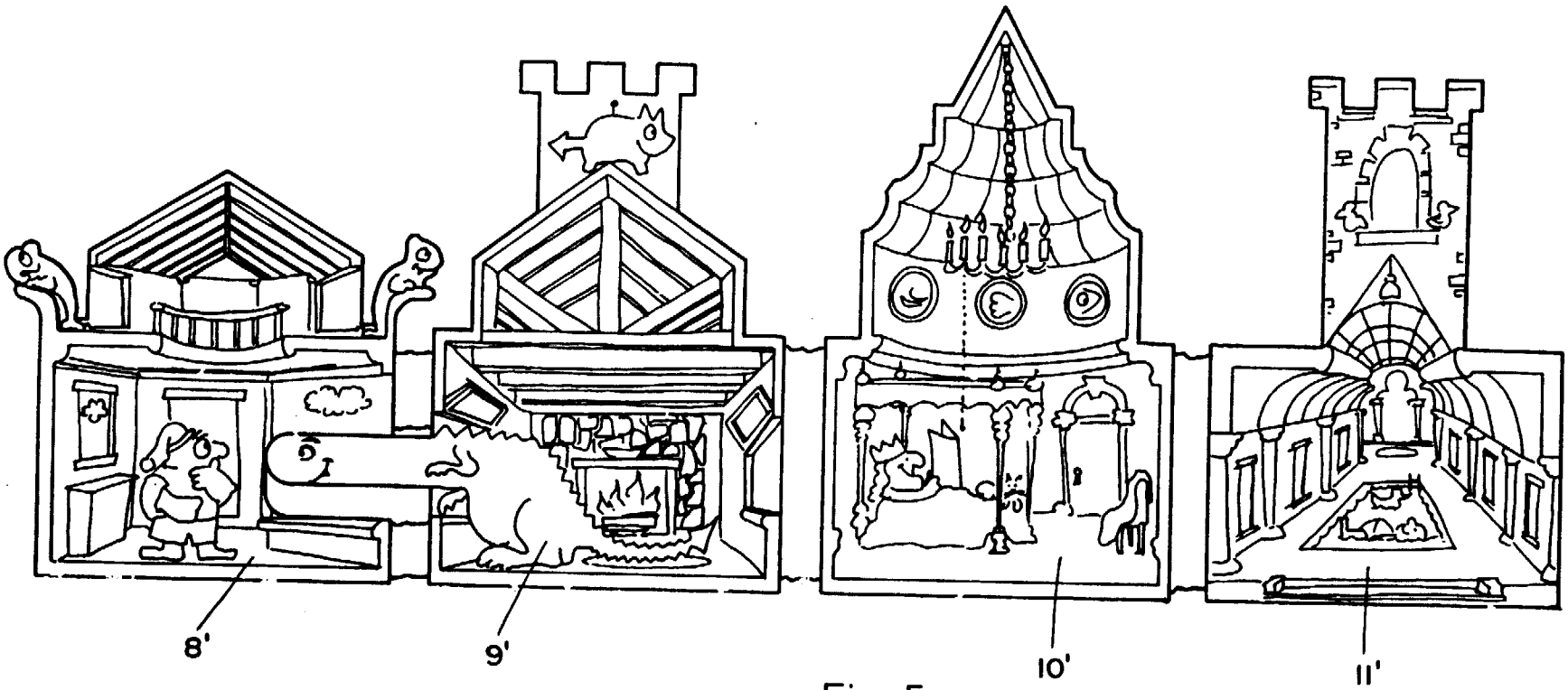
FIGS. 5 and 6 are plan views of linked individual pages of the book of FIG. 1 showing examples of how individual leaves might be illustrated.
Figure 6:
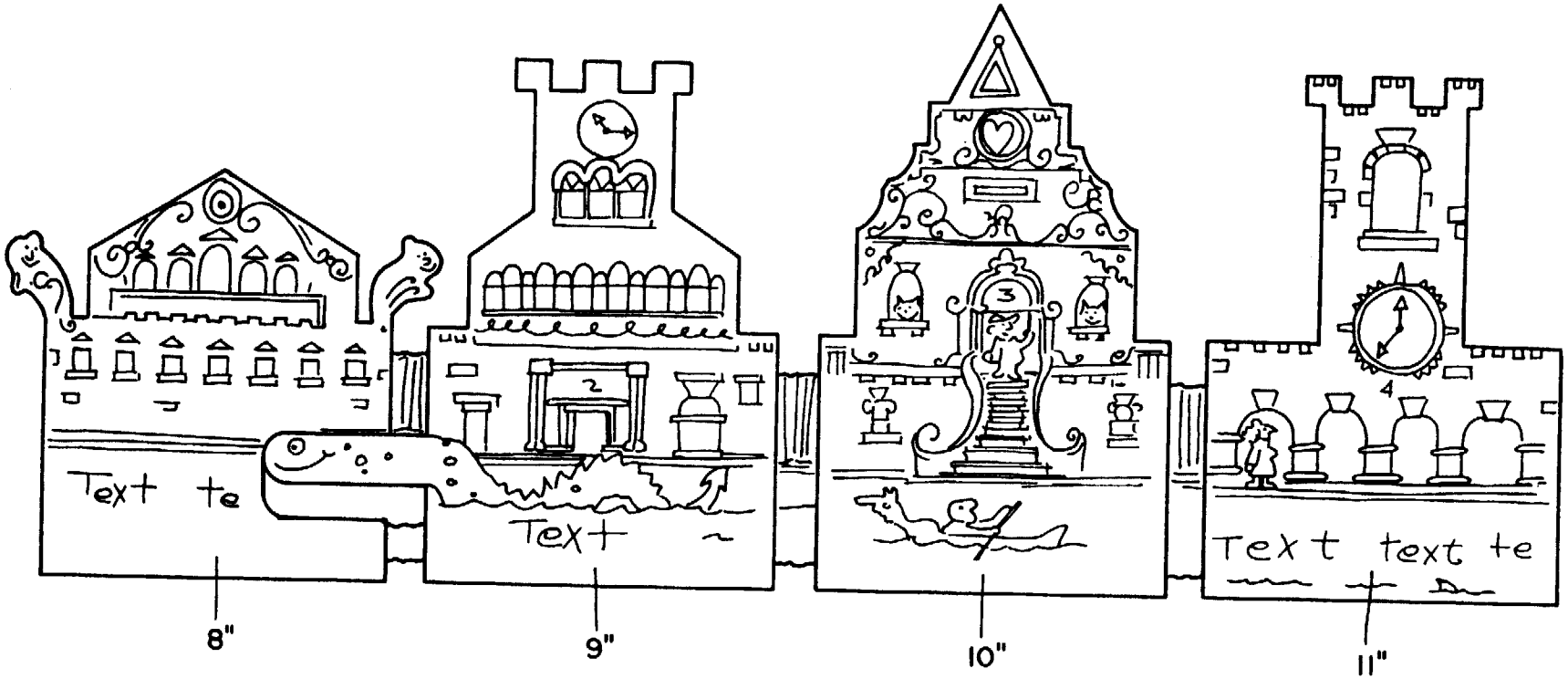
Figure 7:
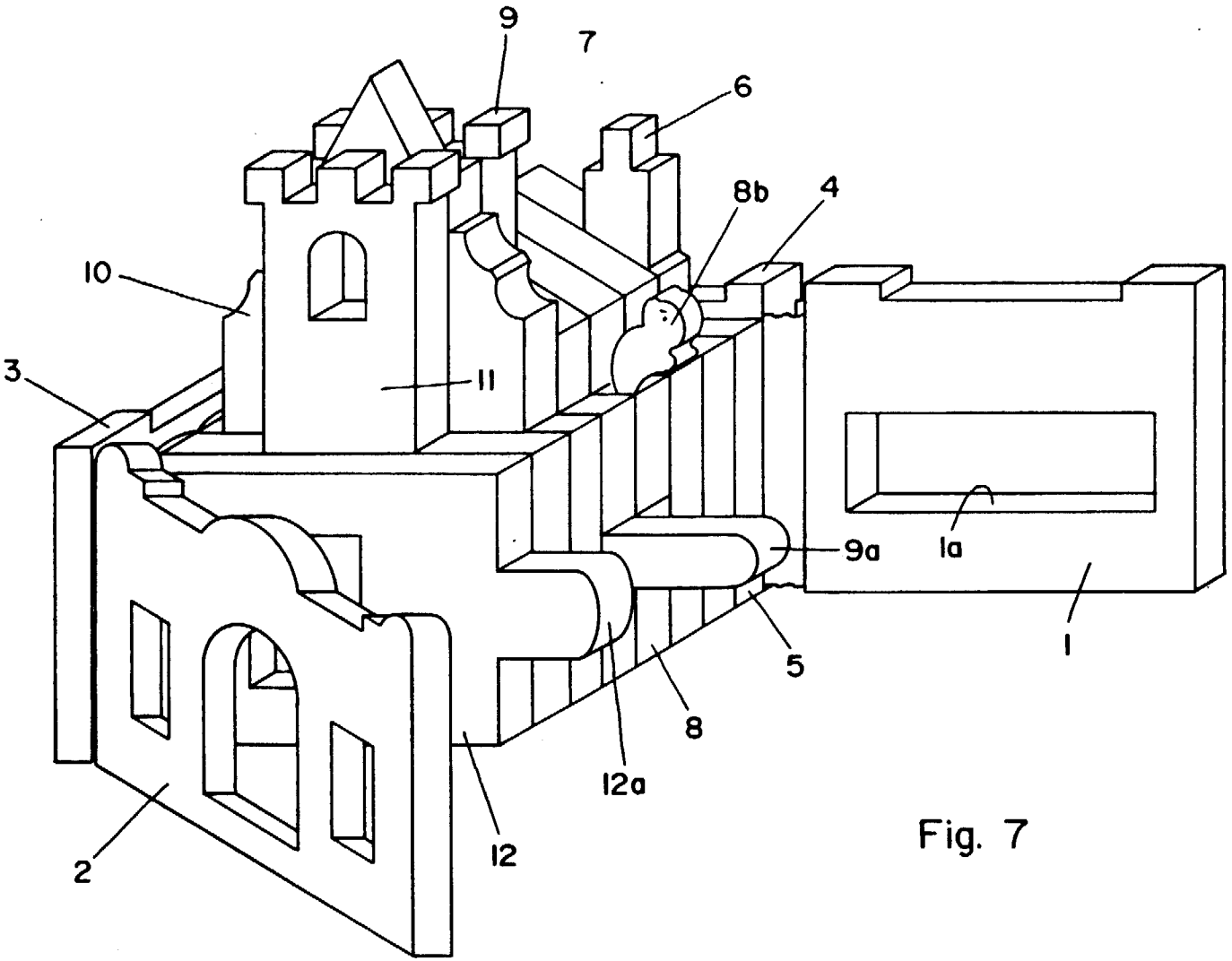
FIG. 7 is a perspective view of the partially opened three-dimensional book of the preferred embodiment similar to that shown in FIG. 1, but utilizing a spine bound folding method for most of the leaves.

Each leaf has at least one face or surface upon which graphical or printed information or indicia, such as the artistic or text indicia on leaf examples 8'–11' and 8''–11'' depicted in FIGS. 5 and 6, can be printed or displayed. Each of the leaves is provided with a distinct shape in essentially two dimensions so that when the leaves are assembled with most of the viewable faces hidden from view, the structure so formed has the distinctly shaped physical characteristics of a three dimensional structure forming a sculpture in the round.

Figure 3:
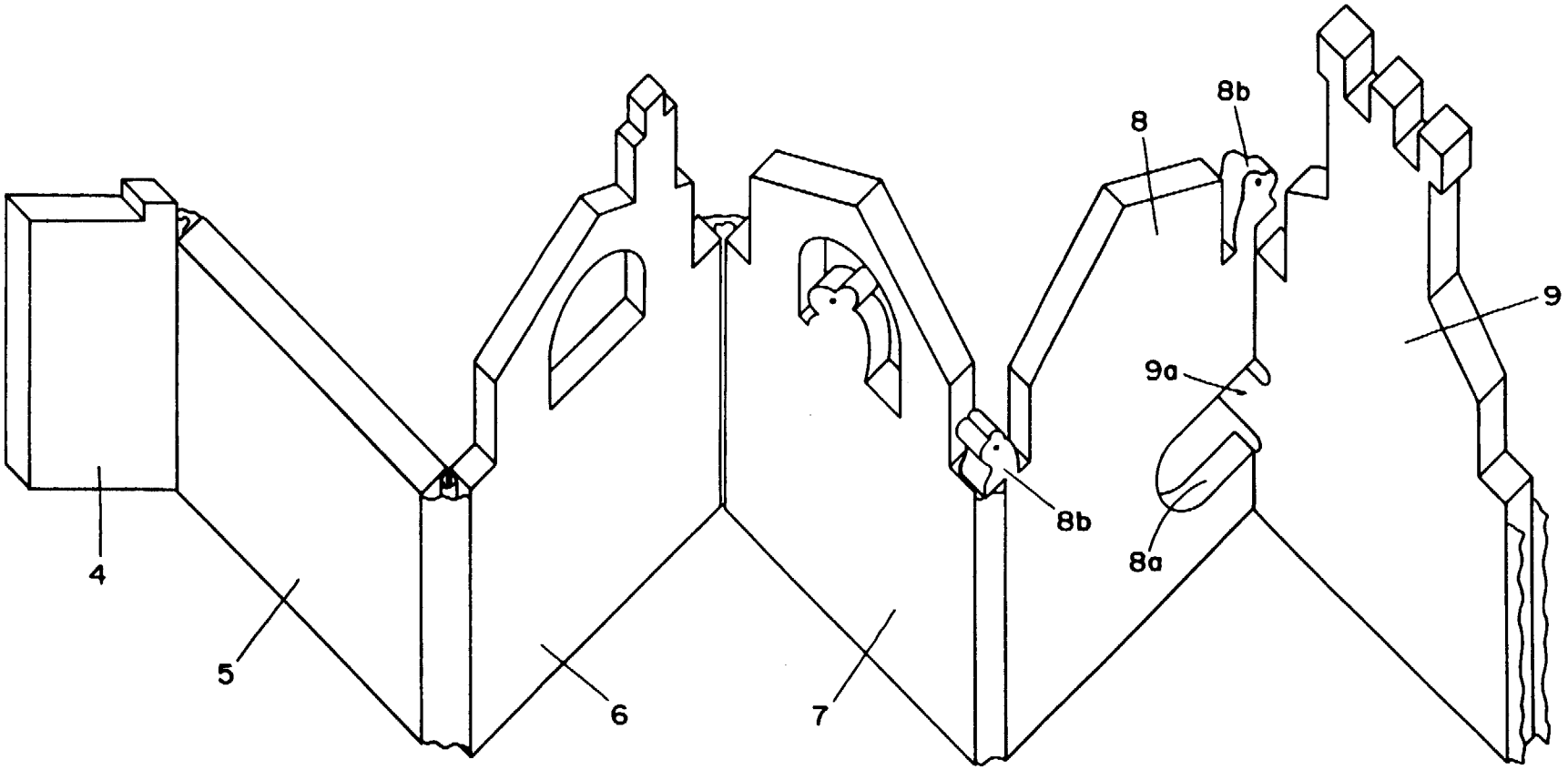
FIG. 3 shows several leaves of the opened structure of FIG. 1 connected together in an ordinary fan-fold relationship.
Figure 4:
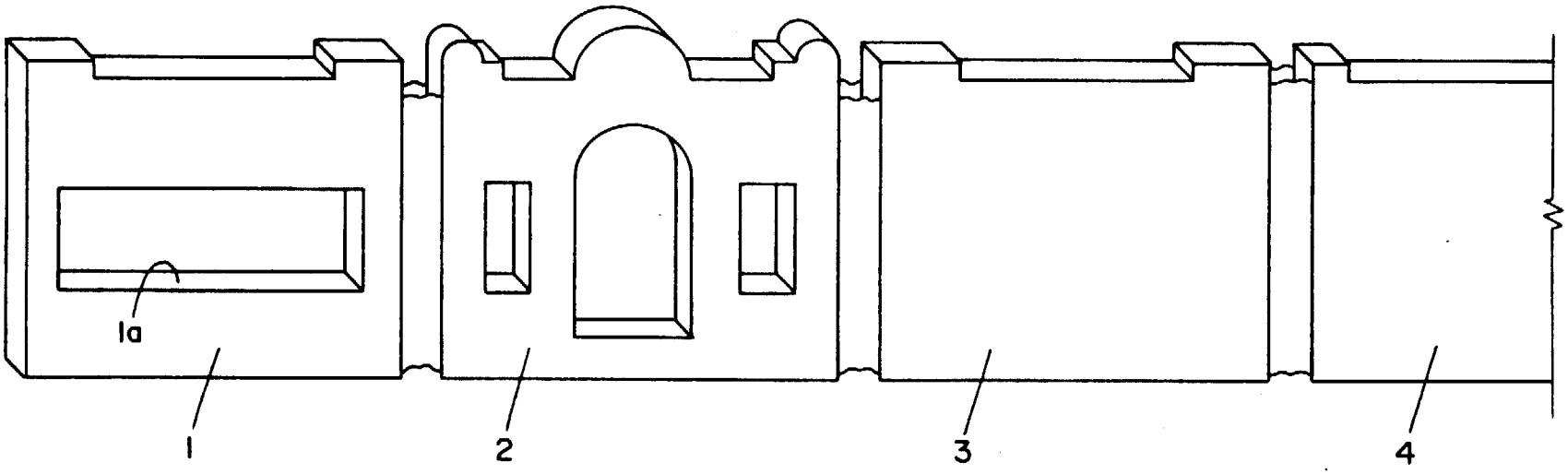
FIG. 4 shows several leaves of the structure of FIG. 1 connected together in an ordinary fan-fold relationship opened fully to a flat planar orientation which all leaves can assume.
Figure 12:
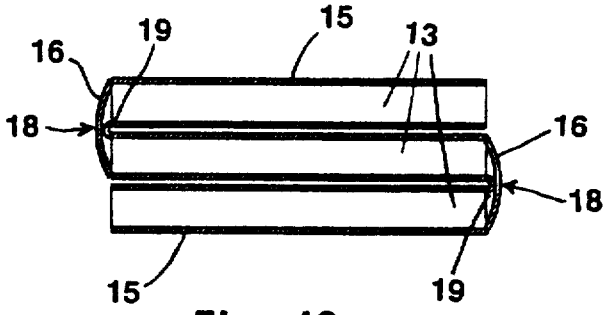
FIG. 12 is a cross section showing detail of a flexible web connection between leaves in a fan-fold structure when closed.
Figure 20:
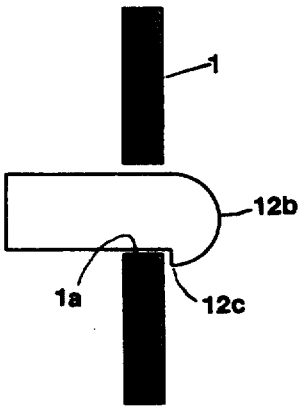
FIG. 20 shows details of a latching means used to hold a structure in its compact form.

In the folding method known as "fan folding", "gate folding" or "accordion folding", representatively shown in FIG. 12, all leaves, excepting the first and last leaves, are connected consecutively, with opposite edges of each intermediate leaf being flexibly attached to the preceding and succeeding leaves. The leaves of this embodiment are hinged similarly to the illustration of FIG. 11, but differ slightly in that adjacent leaves can open only to an essentially coplanar position relative to each other. This fan-fold technique results in a structure which can be opened and laid out flat with all leaves in the same plane and extending consecutively edge to edge in a generally linear fashion. In such a structure the side edges of each intermediate leaf are connected to adjacent leaves while the top and bottom edges of all leaves remain unconnected. Because they are unconnected to any other edge and are free from any interference in either the opened or closed configuration, the top or bottom edges are easily shaped with extensions or cut into any desirable shape. To provide a side edge of a leaf with an extension, such as the nose **9*a* on leaf 9, which will protrude from the closed book to impart three-dimensional shaping yet allow the adjacent leaves to be opened flat into a common plane and to allow the book to be opened flat, an adjacent leaf is provided with a complementary or larger recess, such as recess 8*a* in the edge of leaf 8, along the joined edge to receive the extension as shown in FIG. 3. Leaf 8 also has head figures 8*b* at opposite edges near the top which in the closed configuration overlie the top edges of leaves 1 and 3 in the manner shown in FIG. 1. An extension on one leaf, such as the nose 9*a* on leaf 9 and nose 12*a* on leaf 12, may also pass through an aperture in another leaf, such as the aperture 1*a* in leaf 1. A latching or retaining effect is created when the extension 12*a* is sufficiently large to tightly engage the aperture 1*a* with a frictional fit. To enhance the latching effect, the nose extension 12*b* on leaf 12 may be provided with a lip 12*c*, as shown in FIG. 20**, to more positively engage over and behind the edge of an aperture in page 1 or an edge of an 21 unapertured page which the projecting nose overlies.

Figure 44:
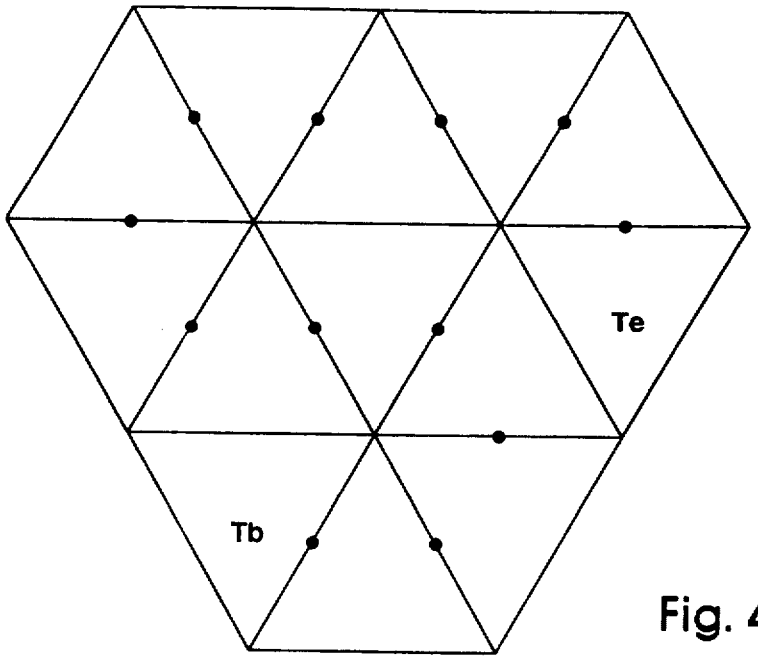
FIG. 44 is a plan view of a pattern in which the planar shape of the leaves prior to further shaping is based upon a generally triangular shape.
Figure 45:
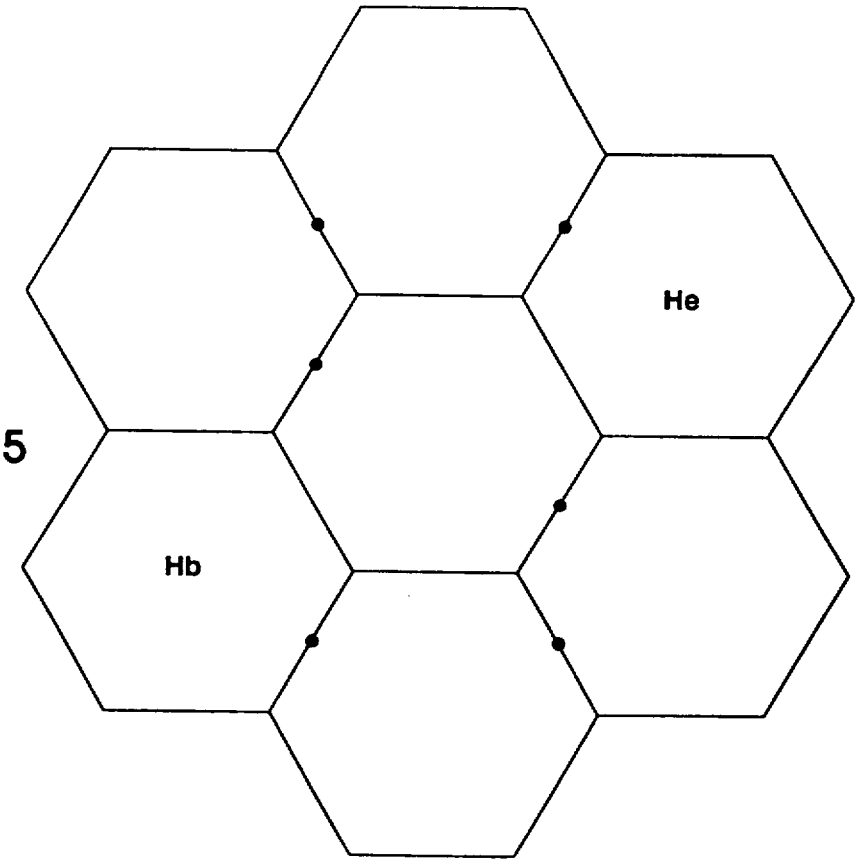
FIG. 45 is a plan view of a pattern in which the planar shape of the leaves prior to further shaping is based upon a generally hexagonal shape.

As shown in FIGS. 13–15 and 30–34, such a three dimensional structure may have a generally cubical or six-sided shape with six predominant sides. In such a six-sided form, the closed structure has at least one generally flat external surface which is capable of serving as base surface for the closed object. This flat base surface is comprised of an external flat surface of a leaf or leaves or of a plurality of edges of leaves of the structure or of a combination of flat leaf surfaces and leaf edges positioned in the same general plane. Whereas a six-sided shape would be formed with generally rectangular leaves, shapes with five or eight predominant sides may be readily formed by folding a flat sheet having a plurality of hingedly interconnected regular triangles or hexagons as seen in FIGS. 44 and 45. While the drawings in FIGS. 10, 12–16, 44 and 45 have examples of plural leaves of identical rectangular size and shape in the respective Figs., it is to be understood that the drawings are representative of structural detail and do not define any limitation of the shapes of the leaves except as may be structurally required or determined by a particular structure. The actual shapes or sizes of the sculptured leaves may be varied as illustrated by the examples of FIGS. 1–9, 21–29 and 34–43 and the edges of the leaves, including the hinged edges, may further be shaped or sculptured as seen in FIGS. 18, 19, 23–27, and 35–40 with curved or beveled cross sections to accomplish any feasible and desirable artistic form.

The web 16 as seen in FIG. 11 allows the adjoining leaves to remain connected along a common line, creating a hinged corner or joint 14 at which the two leaves are interconnected and may be folded through an arc of nearly 360 degrees relative to one another when a sufficient length of web is provided between the edges of the leaves as shown. Accordingly, the connected leaves may be positioned at any relative angle and may be folded flat against and parallel to one another with either face of one leaf lying flat against a face of the other leaf. Alternatively, as shown in FIGS. 12, 16*a* and 16*b*, in order to limit the movement of a pair of connected adjacent leaves to an arc of approximately only 180 degrees at the hinged joint 18, and thereby defining the direction in which the leaves must pivot in order to fold together face-to-face, the cover material 15 extending between one pair of corresponding faces of the two leaves may be limited in width or extent at a narrower web 19 to a quantity less than the combined thicknesses of the two leaves. In folding the two leaves together, such a shortened web may only form the inside of the curve or angle at the hinge. Spine structures of FIGS. 13, 15 and 39–43 similarly limit the angular movement of adjacent hinged leaves.

Figure 13:
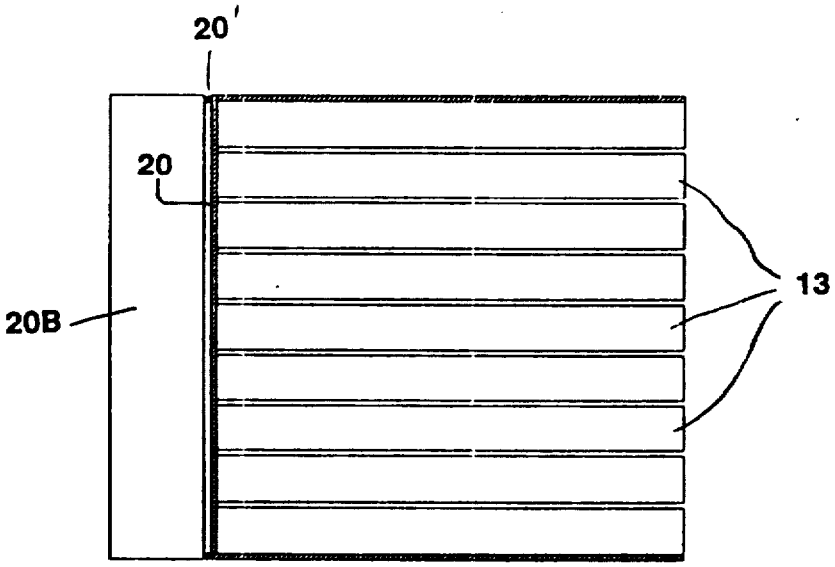
FIG. 13 is an overhead view showing an embodiment having leaves in a spine-bound orientation.

Several methods of attaching all of the various leaves together may be used. In a first method, the structure of the present invention may be bound with the leaves in a normal spine binding fashion, shown in FIG. 13, as is commonly used for any type of book, in which each leaf 13 is attached to the adjacent leaves along one edge and all such edges are joined by a spine 20. The cover material which forms part of the spine 20 may also extend over the outer faces of the outer leaves in FIG. 13. Typically, the leaves connected on such a spine as 20 are located very close to or immediately adjacent one another. Because of this close proximity, the extent of the spine between pages is limited. As discussed above, this limited extent of spine between leaves may limit the direction or angular quantity of movement between adjacent leaves. As shown in FIG. 13, the spine 20 may be covered by means of a flexible spine cover or backing 20B, separate from the spine but hingedly attached thereto at the hinges 20' at opposite faces of the book. The spine cover 20B may be made of a covered flexible foam or of any suitable imprintable plastic so that it can flex as necessary during reading of the book and is of substantial thickness so that it may be sculptured in any desired configuration, which sculpturing may complement any sculpturing of the spine 20 and the edges of the leaves 13 adjacent to the spine so that this side of the book can complement all other sides of the book to define an appropriate three-dimensional structure forming a sculpture in the round.

In a normal spine bound structure, although the edges of each leaf may be attached to the spine of the structure at spaced points, they are less readily adapted than in fan folding to being provided with projections or recesses to create a three-dimensional effect on the side of the structure where the spine binding is positioned. However, any projection on a single leaf may be provided at its spine-bound or hinged edge if opening movement is limited to 90 degrees or if one or more adjacent leaves are cut away, in the manner generally shown for the hinge between leaves 8 and 9 in FIG. 3, to prevent interference with swinging movement of that projection through an arc of 180 degrees. Recessed or intaglio sculpturing of any spine structure which would include carving away parts of the spine bound edges of the leaves may take any desired configuration provided sufficient hinging portions of the spine structure are retained to hingedly support and keep the leaves properly oriented during their hinging movements. If made of sufficiently flexible or sponge-like material, the spine 20, or a member 20B overlying it and attached at least at the upper and lower corners as seen in FIG. 13, could be made of sufficient thickness to be sculptured in raised relief to form one side part of a sculpture in the round.

Figure 15:
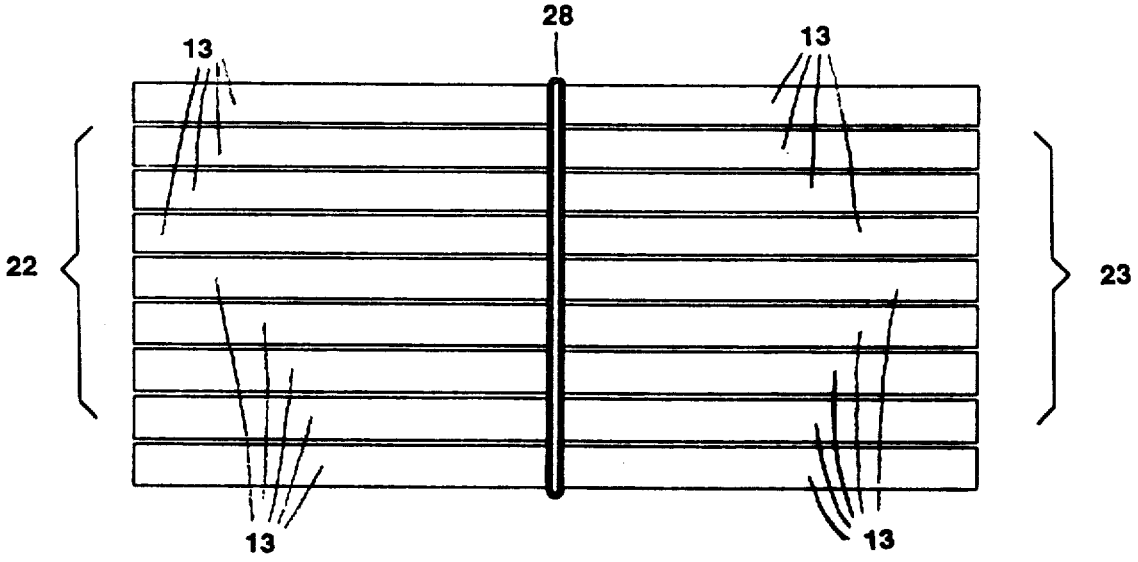
FIG. 15 is an overhead view showing an example of a structure having a central spine-bound orientation.
Figure 16A:
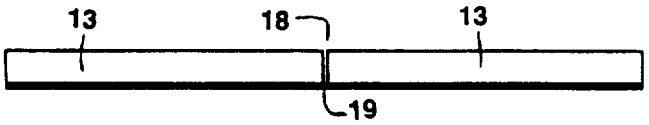
FIG. 16*a* shows a "fan-fold" type of hinge which is only capable of closing in one direction in its open position.
Figure 16B:
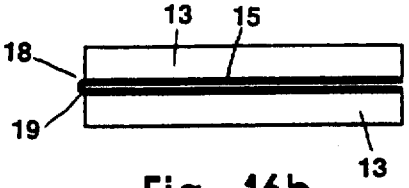
FIG. 16*b* shows the hinge of FIG. 16*a* in its closed position.
Figure 21:
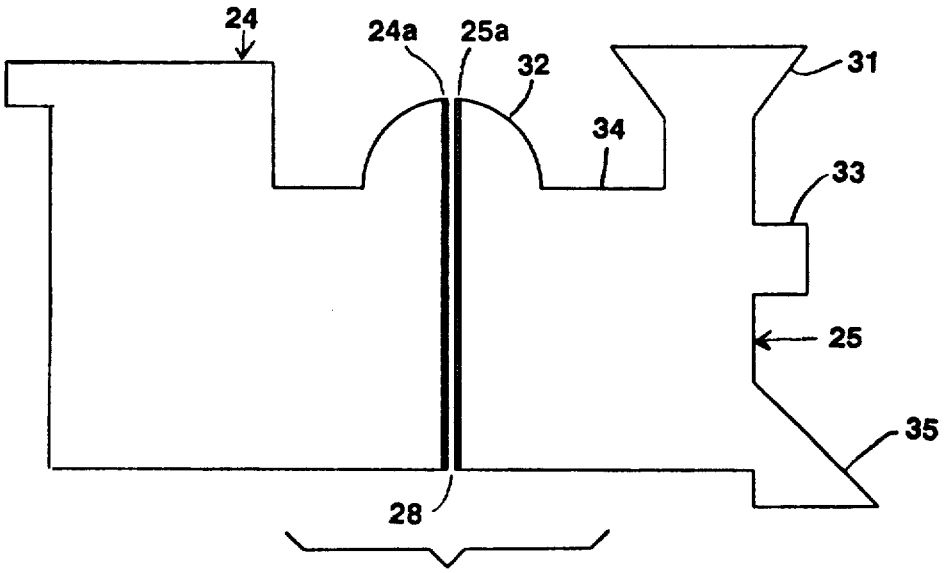
FIG. 21 is an elevational view of an embodiment using a structure similar to that shown in FIG. 15 showing two inner central coplanar leaves used to create an outlined shape of part of a locomotive where the leaves are bound back to back so that all free sides of the respective leaves are capable of being shaped to contribute to the shape of the book structure.
Figure 22:
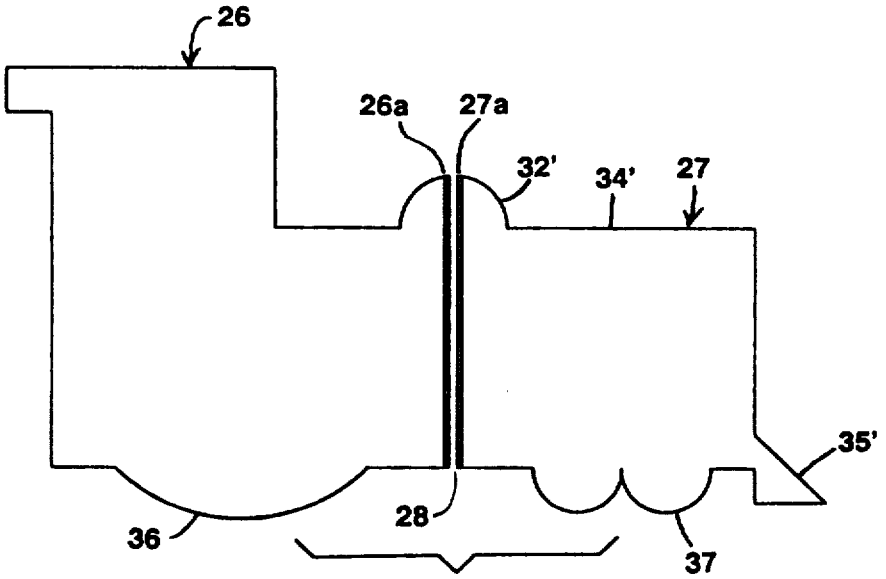
FIG. 22 is a view similar to FIG. 21 showing two outer coplanar leaves in the same structure.

By using the construction shown in cross-section FIG. 15, in which a belt-like spine 28 is located centrally within the structure, all unbound edges of leaves 13 are located to the outside of the structure in coplanar pairs and in stack groups 22 and 23 on opposite sides of the spine 28 and all outer edges of the leaves 3 are free to be provided with recesses or projections to contribute to or enhance a three-dimensional shape of the full sculpture in the round. An example of such a structure is shown in FIGS. 21 and 22 which demonstrate how a full structure in the general shape of a steam locomotive can be created from a combination of multiple layers of two coplanar leaves attached to an endless belt-like spine 28, such as leaves 24–25 and 26–27 attached to spine portions 24*a*, 25*a*, 26*a* and 27*a*, each leaf being essentially four sided with projections or recesses at three curved or irregularly contoured sides and with the remaining unused side of each leaf abutting the corresponding unused edge of the opposite or mating leaf in the same layer. FIG. 21 represents an inner or central pair of coplanar leaves providing maximum sizes of the smokestack 31, dome 32, headlight 33, boiler 34' and cowcatcher 35', whereas FIG. 22 represents an outer pair of leaves in which the headlight and smokestack do not appear, the dome 32, boiler 34 and cowcatcher 35 are of reduced dimensions, and the wheels 36 and 37 have been added. Other pages with appropriate proportioning of the locomotive's features at various vertical planes parallel to its length would be added to complete the structure of the locomotive in the round. In such a structure the binding is essentially completely hidden from view. The endless belt-like spine permits the leaves which have flat faces to be folded during reading at opposite ends of the stacks from one stack to the outer layer of the other stack.

Figure 42:
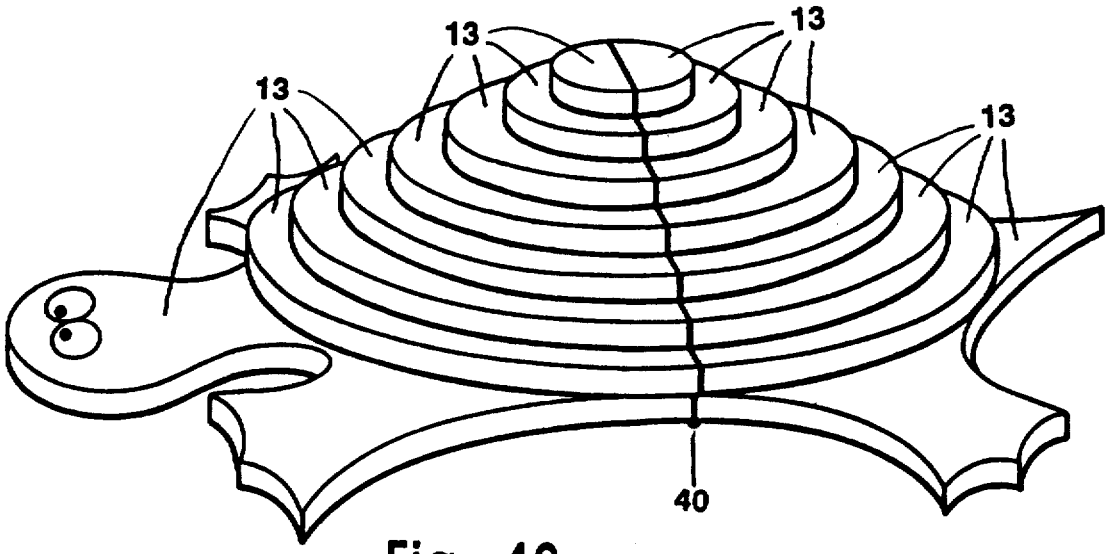
FIG. 42 is a perspective view of a spine-bound book structure in which the spine is folded back upon itself so that it remains on the interior of the three-dimensional structure and need not form any exterior surface.
Figure 43:
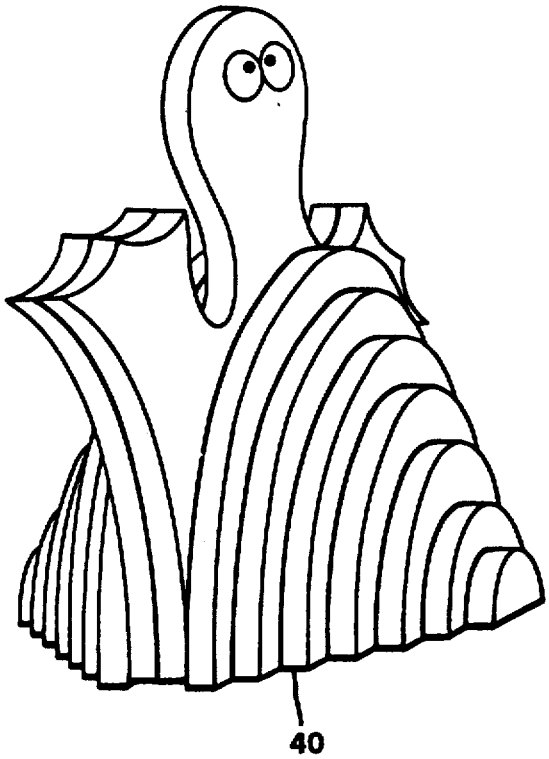
FIG. 43 is a perspective view of the structure of FIG. 42 in which the spine is not folded back upon itself and forms a base surface for the structure.

Another way of concealing the spine is shown in FIGS. 42 and 43, wherein a spine-bound construction of the book may be opened so that the spine is folded back upon itself as in FIG. 42 leaving a three-dimensional turtle-shaped structure in which the spine is essentially in a vertical plane and hidden between the two front and back halves of the object. Because of the thickness of the leaves in the embodiment of FIGS. 42 and 43, the book would normally be folded to the configuration of FIG. 43 before turning the leaves to expose the inner hidden faces of the leaves.

Figure 39:
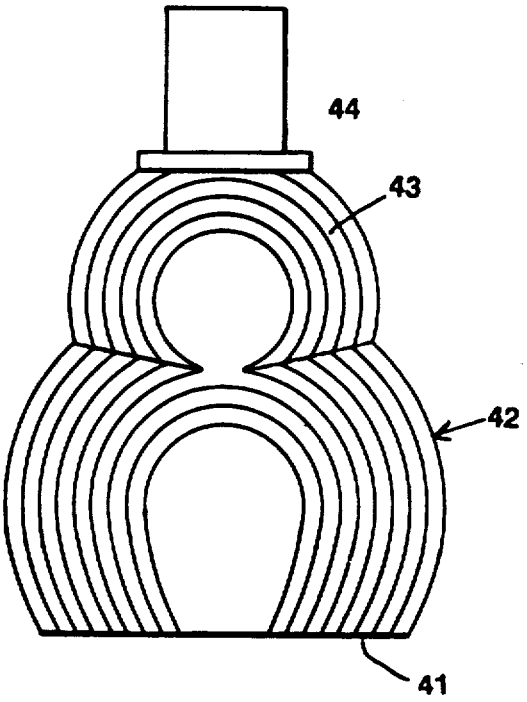
FIG. 39 is an elevational view of a structure in which the folding between all principal leaves occurs at one spine structure but some of the principal leaves are further folded along other axes in order to provide a more complete three-dimensional shape.
Figure 40:
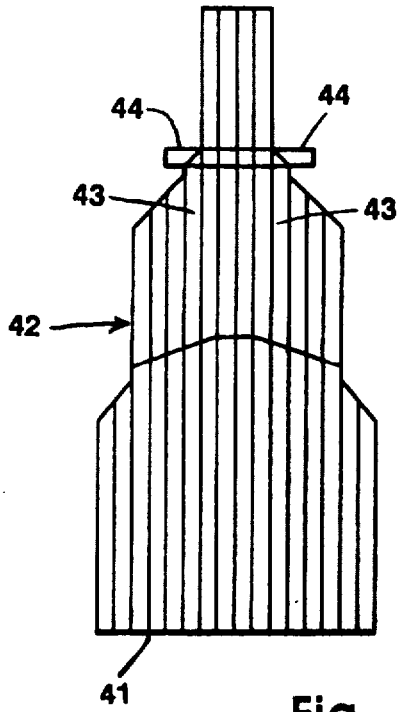
FIG. 40 is a side view of the structure of FIG. 39.
Figure 41:
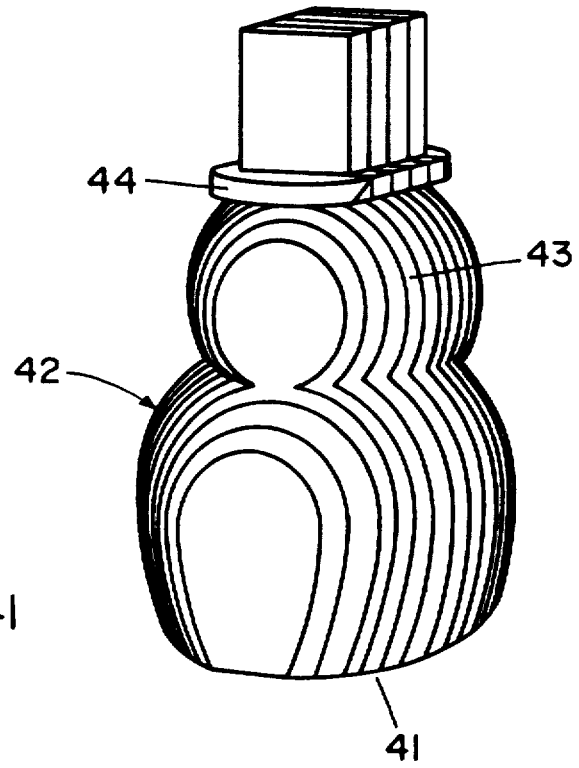
FIG. 41 is a perspective view of the structure of FIGS. 39 and 40.

Since the spine is typically a flat surface, it may also be hidden by positioning it so that it forms a base of the sculpture in the round, such as spine base 40 of the three-dimensional closed book structure as shown in FIG. 43 and the spine base 41 to which all of the parallel vertically extending leaves of the snowman 42 are hinged in FIGS. 39, 40 41. The vertical intermediate leaves 43 in FIGS. 39–41 each have a hinged portion 44 which is folded horizontally to more completely define the brim of the snowman's hat.

Figure 14:
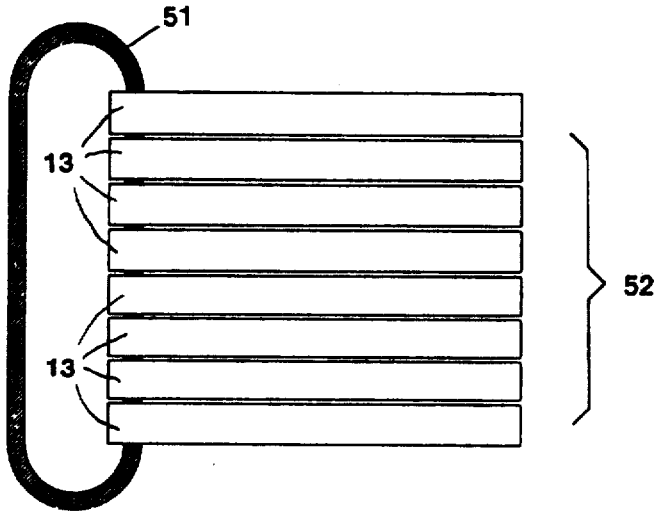
FIG. 14 is an overhead view showing an embodiment having leaves in a ring-bound orientation.

In another variation of the spine bound method shown in FIG. 14 the individual leaves 13 are held together by one or more endless rings or wires 51, with each ring passing through a perforation or aperture in, and near the edge of, each of the leaves. The leaves 13 are thus free to be moved one at a time along the ring 51 and the entire stack of leaves 52 may be moved around the ring one at a time for reading whereby the stack may 52 be completely moved around the rings circumference.

Figure 25:
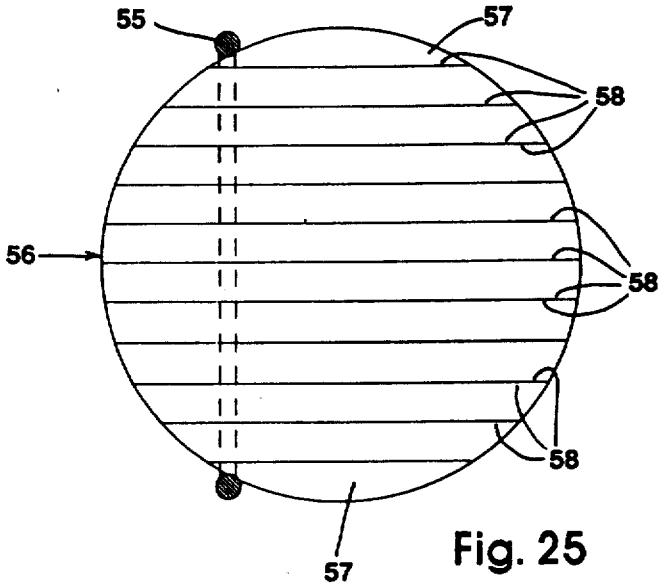
FIG. 25 is a plan view of an embodiment in which the closed structure is in the shape of a ball and in which a pin or cord hinging means is used.
Figure 26:
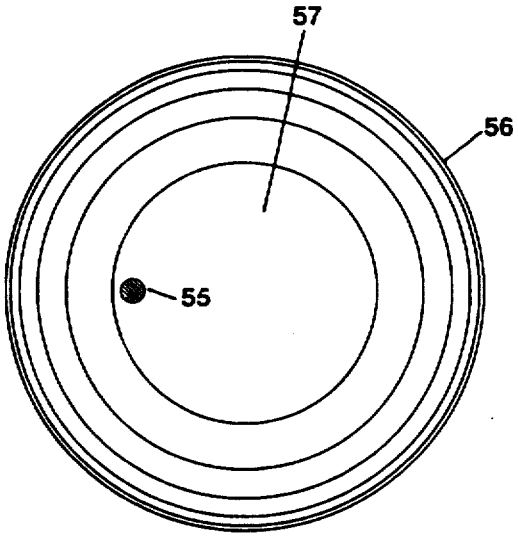
FIG. 26 is a plan view of the embodiment of FIG. 25.
Figure 27:
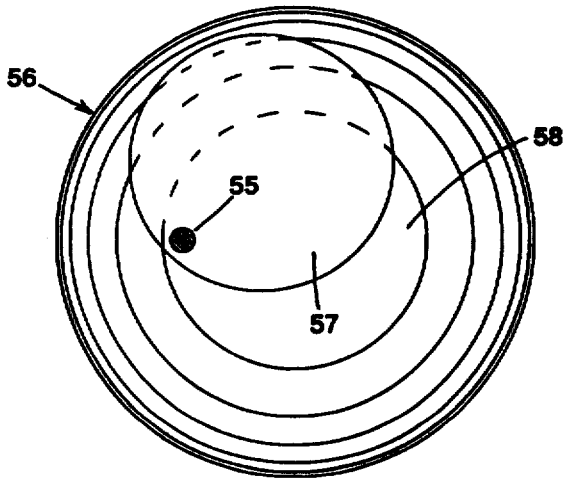
FIG. 27 is a plan view of the ball shaped embodiment of FIG. 26 showing the relative planar movement of a single leaf.

Another suitable binding method as shown in FIGS. 25–27 provides for the use of a headed member 55, such as a flexible pin, flexible elastic or inelastic cord passing through a relatively small aperture in each leaf of a ball-shaped book 56, each aperture being only slightly larger than the diameter of the pin or cord. An elastic cord, or a cord with a knot at one end and a releasable cord-lock slidable along its other end, is capable of becoming elongated along its leaf-supporting length within the leaves and allows the respective leaves to be hinged open for reading in a normal "book" fashion. A non-elastic pin or cord generally allows any individual leaf, such as the end or top leaf 57 as shown in FIG. 27, to be rotated about the axis of the pin or cord only in the plane of the leaf, thereby exposing to view the previously hidden portions of flat surfaces of other leaves, as at 58 in FIG. 27.

Figure 23:
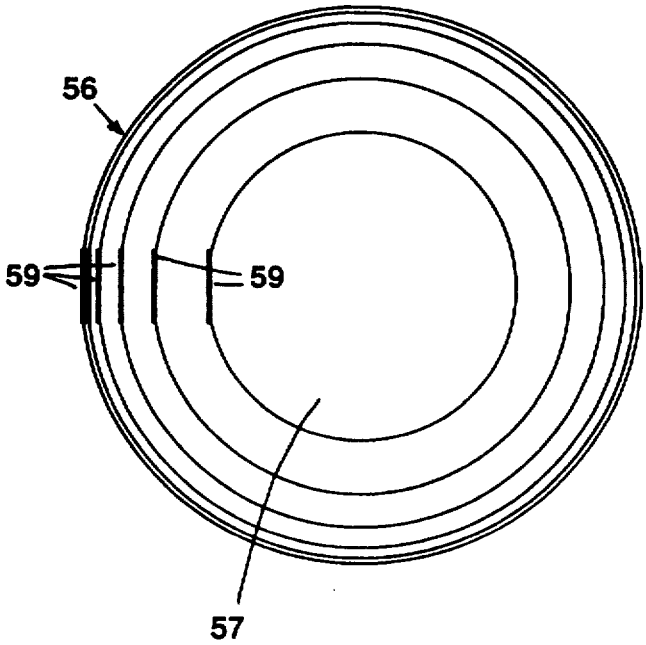
FIG. 23 is a plan view of an embodiment in which the closed structure is in the shape of a ball.
Figure 24:
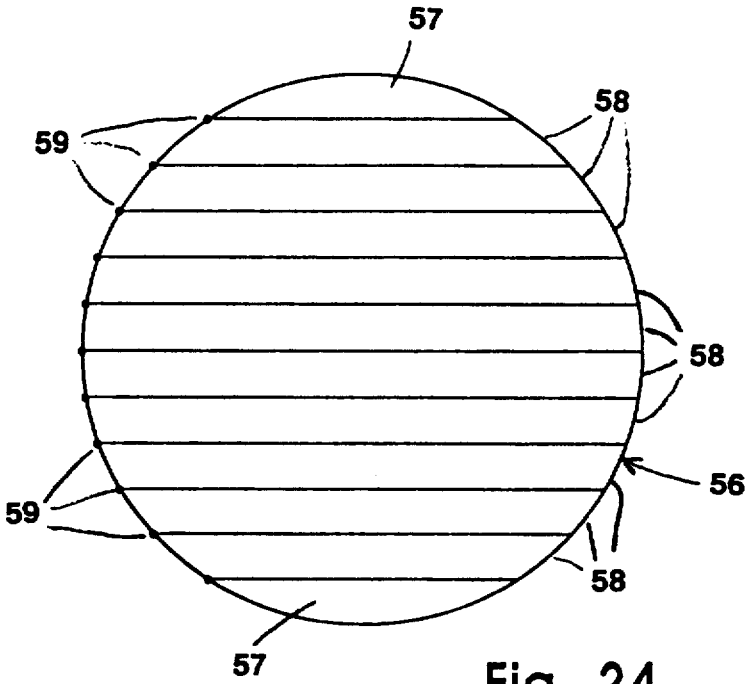
FIG. 24 is a side view of the embodiment of FIG. 23.

FIGS. 23 and 24 show ball shaped structures similar to FIGS. 25–27, but having individual hinge members 59 between adjacent leaves throughout the stack of leaves. The hinge members may be folded portions of thin tear-resistant paper or plastic material which is used to cover the hidden faces 58 of the adjacent leaves at the hinge location. The outer surfaces of leaves 57 as well as the edges of the other leaves may have other curved or irregular configurations to form other sculptures in the round.

Like some of the other embodiments of the invention, FIGS. 23 through 27 illustrate a multiplicity of individual leaves with leaf supporting means therefor arranged so that the locations of the interconnecting means for respective leaves are arranged with these locations lying along a locus having a continuous path, such as, for example, a line as in FIGS. 25–27 or along a curved path as is assumed by the hinge locations 59 in FIGS. 23–24.

Figure 28:
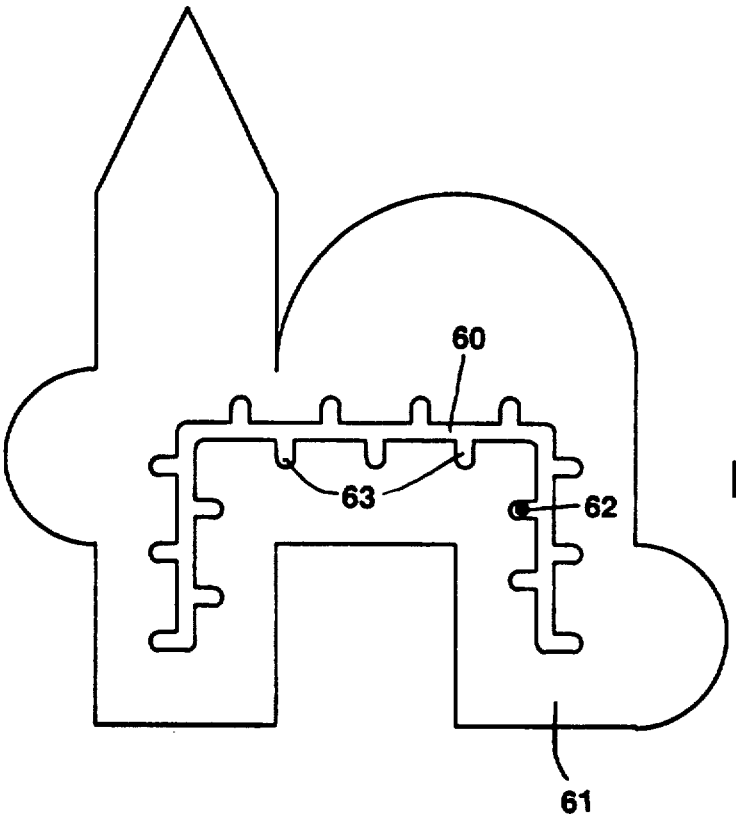
FIG. 28 is a plan view of a leaf of an embodiment in which a pin binding means passes through an elongated track in a leaf.
Figure 29:
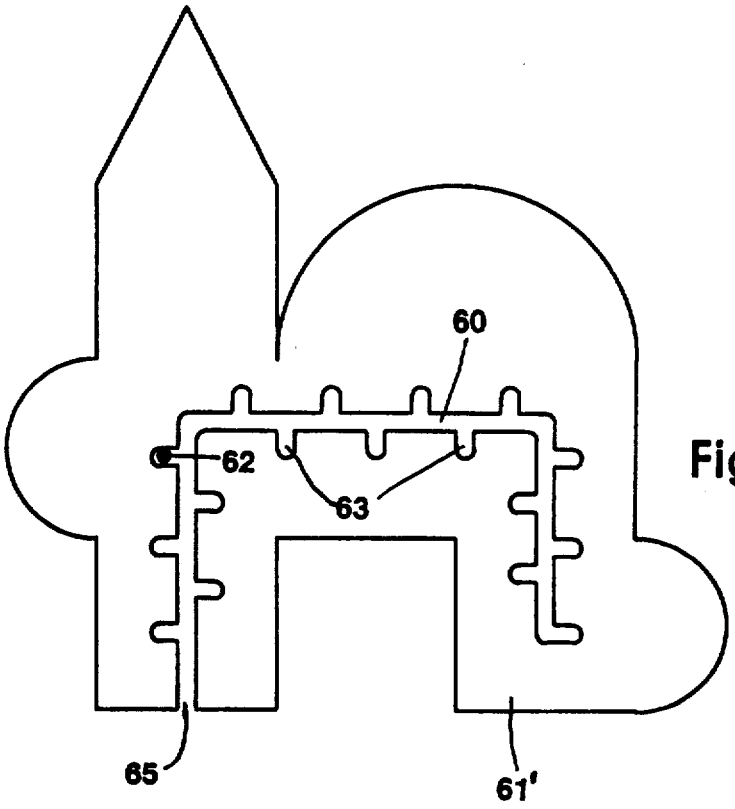
FIG. 29 is a view similar to FIG. 28 in which the elongated track is open at one end to allow removal of the leaf from the pin.

FIGS. 28 and 29 illustrate the use of an elongated irregularly shaped track opening 60 in a leaf 61, for use in conjunction with a pin 62 as described above, in place of an aperture in each leaf. The track has a plurality of pin-receiving notches 63 at opposite sides at spaced points along its length whereby the leaf may be moved to a great variety of positions relative to the pin 62. This track 60 allows the leaf to be rotated about the pin 62, or translationally moved relative to the pin 62, in the plane of the leaf to achieve varying positions and orientations with respect to any other leaf. Other leaves in a stack of leaves retained by the pin 62 may have appropriate shapes which when in one arrangement on the pin 62 cooperate so that the stack of leaves define, in an original position relative to the stack, a desired sculpture in the round configuration and in which configuration the leaves may contain on hidden surfaces any desired indicia. If the shape of the track is uniform from leaf to leaf and known to a user of this structure, it simply requires manipulation of leaves to expose other leaves for inspection of the hidden indicia. However, the shape of the track as well as the locations of the notches 63 may be varied from leaf to leaf and at least partially hidden from view whereby it becomes a puzzle to move the leaves to reveal various hidden indicia or to return the leaves to their configuration defining a particular sculpture in the round after the leaves have been substantially disarranged by moving all leaves from their original position relative to the pin 62. By providing the track 60 with an open end 65, as seen in FIG. 29, the leaf can be readily removed from the pin 62. This feature can be combined with features mentioned above and also allows for an original position as described in which a desired sculpture in the round can be made, but also provides for assembling the respective leaves of such a structure in varying sequence, thereby changing the shape and appearance of the closed structure. By having a removably threaded head on a pin as in FIG. 25, or a ring as in FIG. 14 which is openable for insertion or removal of leaves, the sequence of leaves could also be changed.

Figure 30:
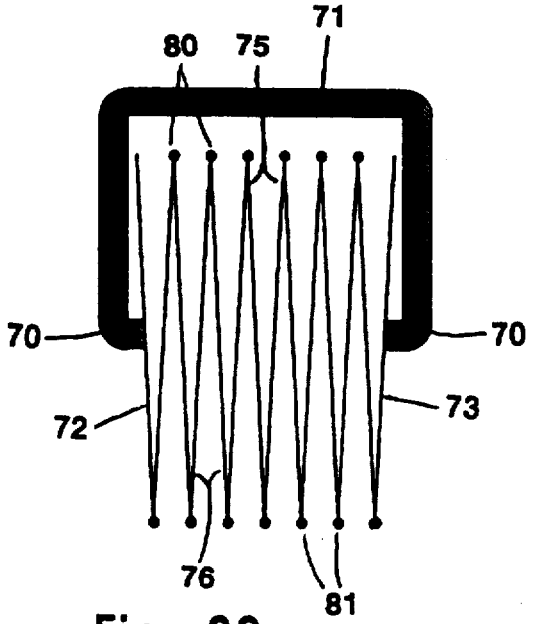
FIG. 30 shows a fan-fold embodiment with a pivotable C-shaped binding member holding one set of edges together.
Figure 31:
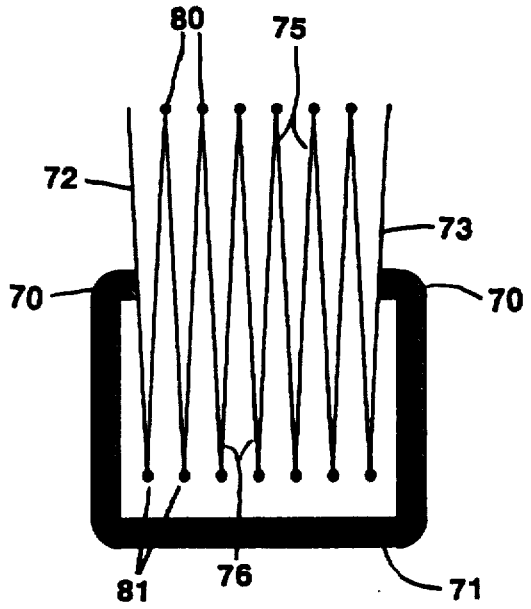
FIG. 31 shows a the fan-fold embodiment of FIG. 30 with the binding member in an alternate position.

FIGS. 30 and 31 show a fan fold structure in which the ends 70 of a "C"-shaped flexible or resilient binder or clamping member 71 are pivotably mounted to the outermost leaves 72 and 73 of the closed structure and the binder 71 is selectively movable manually between the orientations shown respectively in the figures, whereby the readable or viewable printed information contained on one or more leaves of selected set of leaves may be made selectably accessible. The binder prevents the separation of leaves on the side nearest the binder, thus allowing the leaves to be separated or "opened" only on the side away from the binder and creating two distinct sets of viewable leaf surfaces. By selectably positioning the binder in one of these opposing positions only the printed information contained on one selected respective set of surfaces 75 or 76 of different respective sets of leaf surfaces may be exposed to view at any one time. By making the clamp member of a resilient material, such as commonly available plastics, the spring effect of ends 70 of the clamp member 71 pressing against the stack of leaves tend to hold their position against the opposite sides of the stack, as shown, and thereby hold the leaves of the stack in place and prevent them from unfolding.

Figure 32:
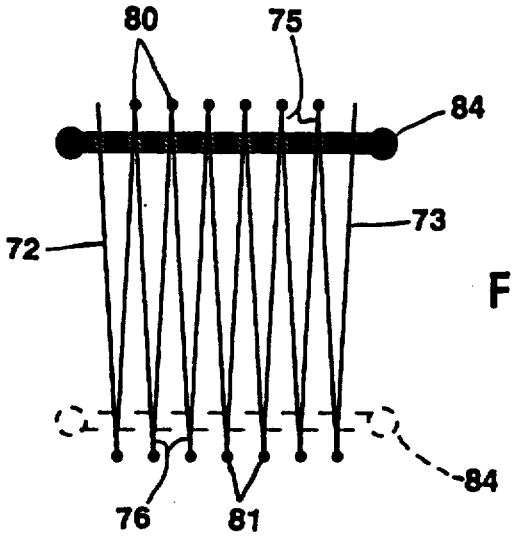
FIG. 32 shows a fan-fold embodiment with a selectable position pin binding member holding one set of edges together.

As shown in FIG. 32, a stack of leaves comprising a fan-fold structure with parallel groups of hinges 80 and 81, which alternate in direction of opening, may be provided with a means of selectively binding together the hinged edges at one side 82 or the opposite side 83 to form a structure which is essentially equivalent to a spine bound structure and in which each leaf is effectively made of two thicknesses of the leaves of the fan-fold structure. As a selected group of hinges, for example hinges 80, is bound together, the edges of pairs of adjacent leaves hinged by the opposite hinges 81, are also effectively bound together by their respective hinges. Being bound on opposite edges prevents the separation of these two connected adjacent leaves of each pair thereby limiting the viewing of printed information or indicia on their adjacent faces. The selectable binding means may be a binder ring or a simple pin passing through holes in the leaves and having two selectable positions as shown in FIG. 32.

Figure 10:
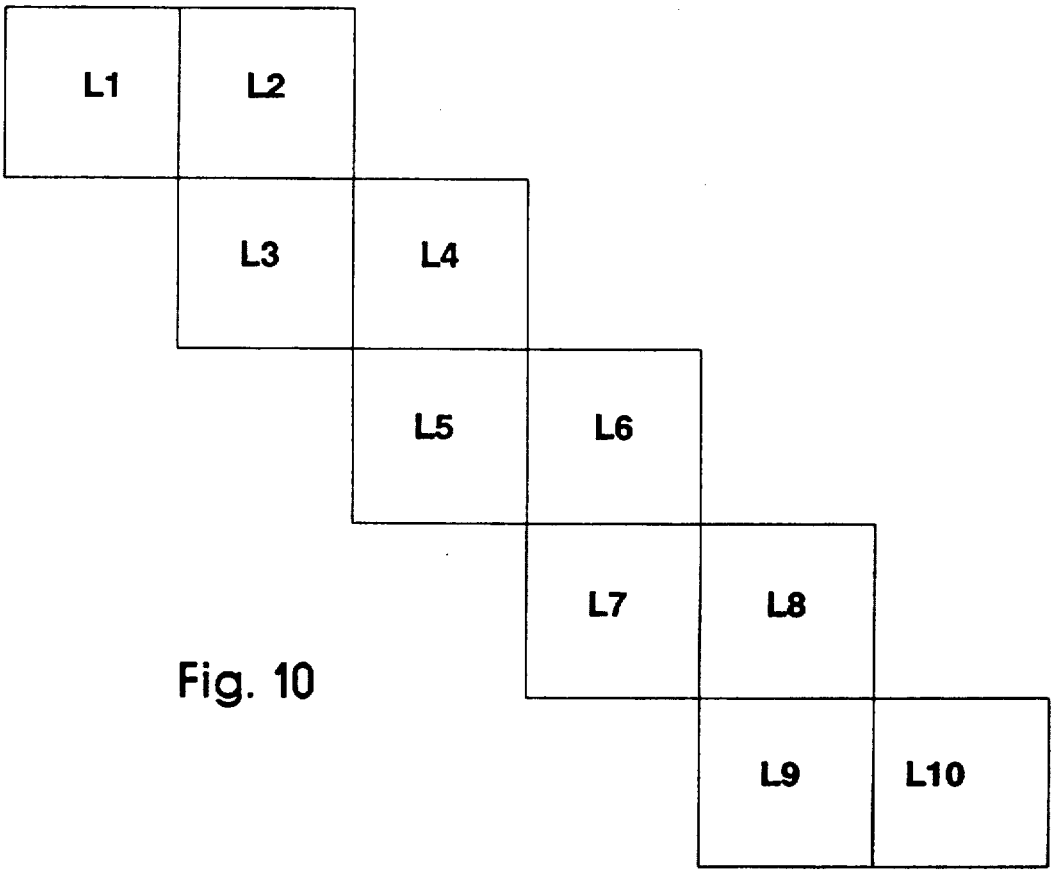
FIG. 10 shows a variation of a fan-fold technique using simple square leaves to illustrate an assembly technique in which alternating hinge axes are perpendicular to one another.

Using variations of the fan-fold technique, the folding connections on each leaf can be angularly arranged perpendicular to one another so that, for instance, the edges of the leaf which are hinged to adjoining leaves are adjacent to one another, sharing a common vertex, and are not parallel to one another. As shown in FIG. 10, such a folding method provides a book structure which is capable of being fully opened and laid flat, but which when closed allows the unconnected edges of each page to have varying orientation so that extensions of these edges, which are used to create a three-dimensional effect, are positioned on varying exterior surfaces of the closed book. In the simple form shown in FIG. 10, in which each page is represented as generally square, and the leaves are of such thickness that closed the book is generally cube shaped, such a folding method provides for a three-dimensional structure in which a combination of at least two of the unfolded top, bottom and two side edges of various leaves may have extensions or cuts, and the folded edges may have complementary extensions or recesses to enhance the three-dimensional appearance of the structure.

FIG. 10 illustrates ten generally square leaves foldably connected together. Each leaf is provided with two opposite faces, one of which is the face shown in FIG. 10. The line dividing any two square leaves represents a foldable hinge connecting the two leaves. The structure is folded from its flat open orientation as shown into a generally cubical structure using nine folds along these horizontal and vertical hinges as shown. Assuming that the leaf labeled L1 remains stationary throughout the folding process, leaf L2 is folded so that one of its two faces is folded to directly abut a face of L1 "behind" L1. Then each succeeding leaf L3–L10 is then is folded into place in sequence so that one of its faces face directly abuts a face of the preceding leaf. Thus the leaves become stacked one upon another in consecutive order. Using such a pattern, each leaf has at least two edges which are not foldably connected to another leaf, and the orientation of the free edges with respect to the closed structure varies from leaf to leaf in the closed structure as is more clearly seen in FIG. 33.

Figure 33:
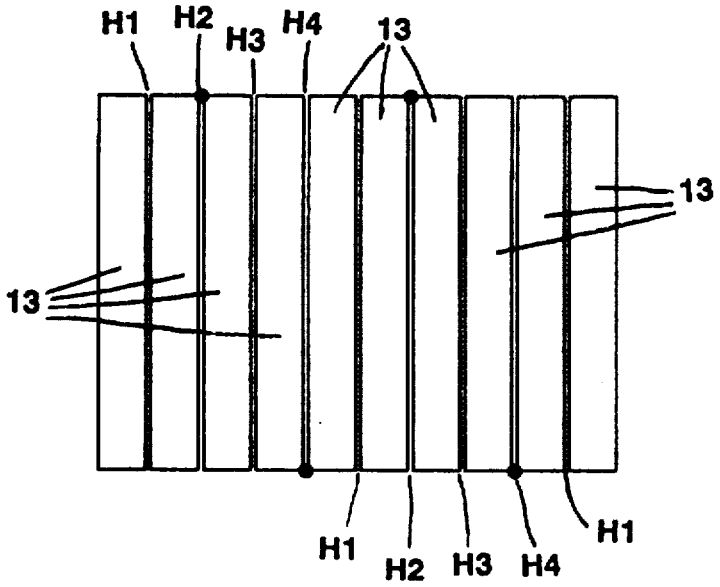
FIG. 33 is a plan view of the folded structure of FIG. 10 showing the change in orientation of the hinges through the various portions of the structure in its compact configuration.
Figure 34:
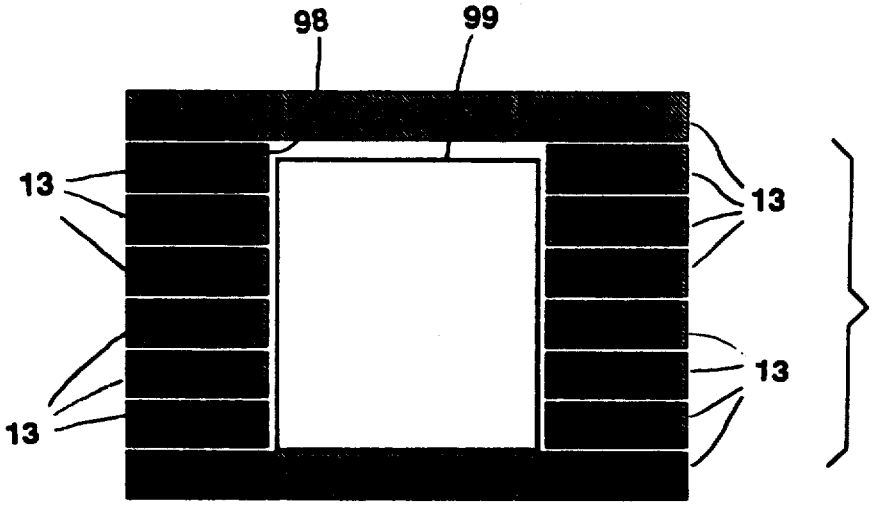
FIG. 34 is a side view of a structure comprised of multiple layers of single leaves in which all leaves except the outermost two are provided with aligning cutouts so that the interior of the three-dimensional structure is capable of serving as a closed compartment and in which a separate receptacle is attached to the inside surface of one of the two outermost leaves.

FIG. 33 illustrates a structure created from relatively thick leaves folded according to the pattern of FIG. 10. In the compact folded structure of FIG. 33 as shown, the orientation of the direction toward which any two adjacent leaves may be opened varies, being in four mutually distinct directions as determined by the respective positions of the hinges between any two adjacent sides. For each distinct direction of orientation H1, H2, H3 or H4, the group of hinges which may be held together at one side of the stack to define the direction of orientation, which would be toward the opposite side of the stack, comprises every fourth hinge, beginning with any individual hinge allowing such orientation. Each such orientation of the opening of a pair of adjacent pages allows the hinged leaves to be opened in a distinct direction to allow the surfaces of the leaves to be exposed and viewable from a direction generally perpendicular to the hinge axis for those two leaves. By using a pivotable binder such as that shown in FIGS. 30 and 31 with the folded stack of leaves of FIG. 33, four separate sets of viewable faces may be made selectably viewable. When viewing one set of faces each effective page comprises four individual leaves which are held against any significant separation by the hinges which are not held as a group by the flexible binder.

An alternative to the binding clamp 71 for selectively holding the hinged edges of a sculpture in the round at one of two or more different sides of a sculptured stack, such as the stack of FIG. 32 or of FIG. 33, may include holding means comprising two straps each being pivotably attached at one end to a central area of an outer face of one outermost leaf at one end of the stack, the straps being wrapped closely around opposite sides of the stack in its compact completely closed configuration with the other ends of said straps being attached as by releasable snaps to a central area of an outer face of an outermost leaf at the other end of the stack. Such straps are manipulatable whereby a first strap at a first side of the stack is releasable to allow leaves to be separated at the first side for inspection of a first set of leaf surfaces at that first side while the hinges at the opposite side of the stack are held together by the second strap remaining with both ends attached to said outer faces. To view a different set of leaf surfaces, the first strap is secured to both faces and the second strap at said opposite side of the stack is released to allow leaves to be separated at its respective side for inspection of the second set of leaf surfaces thereat while the hinges at said one side of the stack are held together by the first strap remaining with both ends attached to said outer faces. The stack may have multiple pairs of inspectable opposite sides as in FIG. 33 and a strap having releasable ends may be attached to the outer faces to hold its respective set of inspectable leaves closed. In such case the straps are appropriately released, except for the strap opposite the set of leaves to be inspected, to allow such separation of any set of leaves opposite the strap which remains secured.

Figure 8:
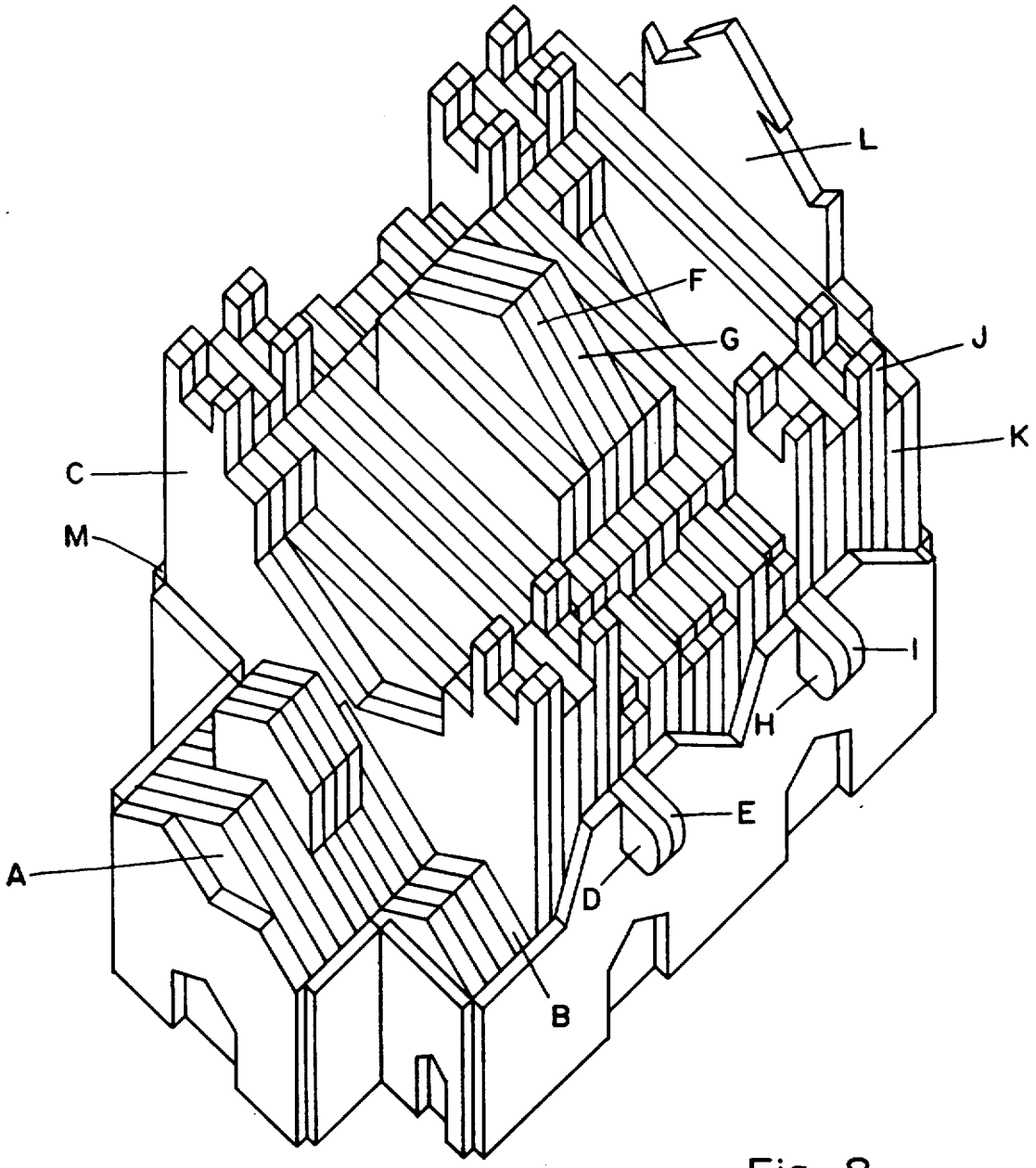
FIG. 8 is a perspective view of the closed three-dimensional book structure of an alternative embodiment in which the structure can be opened to a flat planar orientation.
Figure 9:
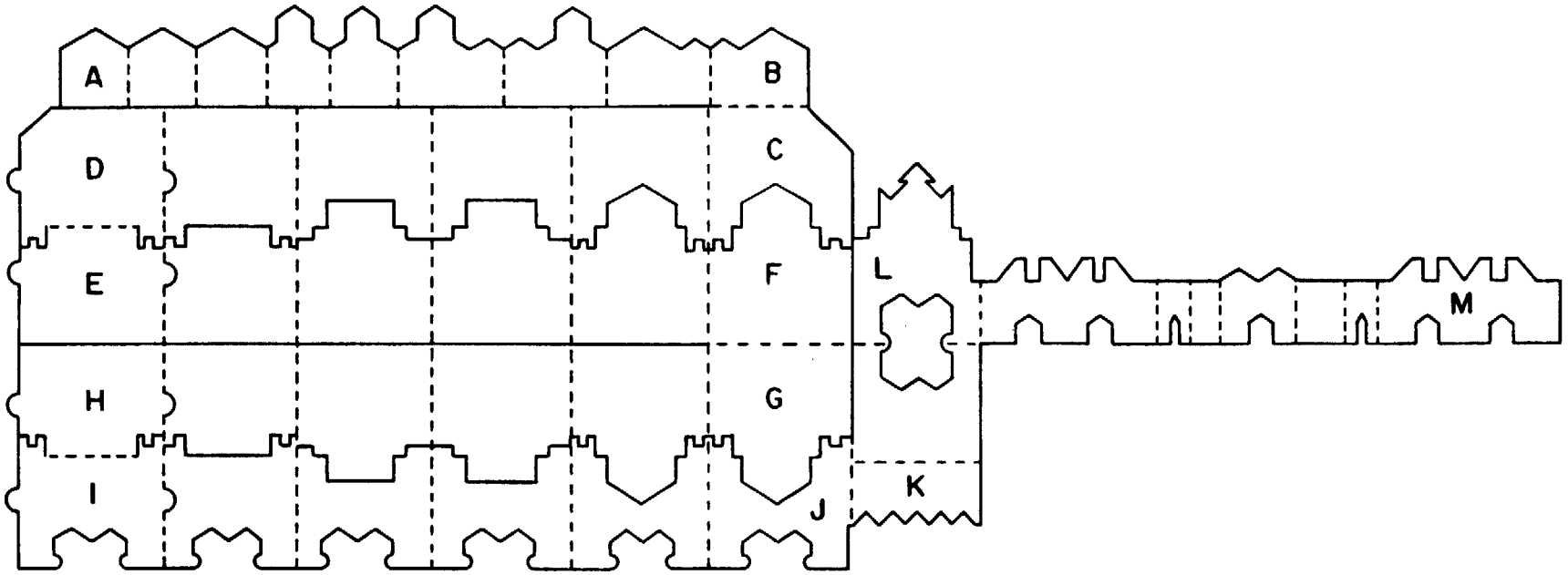
FIG. 9 is a plan view of structure of FIG. 8 opened into its flat planar orientation, and showing the pattern of cuts and folds between the various leaves.

The book structure may also be constructed as a very complex castle-like compact configuration as seen in FIG. 8, but yet being unfoldable to the expanded configuration of FIG. 9 with all the leaves foldably interconnected in a single plane, where the planar surface can be given the outline of a recognizable shape, such as an actual or imaginary animal. As shown in FIG. 9, the planar area defined by the arrangement of leaves can be essentially completely filled, allowing such a structure to be used, for example, as a game board or poster. In the plane, the boundary between two adjacent leaves is defined by either a cut or a fold. As shown in FIG. 9 solid lines between adjacent leaves indicate a cut, broken lines indicate a fold with dotted lines indicating a fold which is concave upward as viewed in the plane and a dashed line indicating a fold which is similarly concave downward.

The foldable structure of FIG. 9 comprises a plurality (seven in this case) of multi-leaf rows of leaves each of which has several parallel fold or hinge lines or axes. Letters A through M of the alphabet are used in sequence for certain of the leaves to more clearly show the sequential folded relationship of all of the leaves of this embodiment. The first row of leaves extends from leaf A to leaf B and comprises nine leaves each having one irregular and three straight edges. The four rows C-D, E-F, G-H and I-J are each parallel to row A-B and each of these four rows comprises six leaves having various edge configurations. Leaf K is also in the same row as I-J, but begins multi-leaf row K-L which extends transversely of the directions of the parallel rows. Leaf L begins the last row L-M parallel to the other four parallel rows. Note that row I-J-K has leaves of generally rectangular shape and of various sizes, but also the leaves have from one to four irregular edges, leaf K having one such edge and leaf I having four irregular edges. The row L-M has two intermediate leaves having four straight rectangular sides, but these leaves are of different sizes and shapes and combine with the other leave of FIG. 9 to for a sculpture in the round when this embodiment is folded to the compact configuration of FIG. 8.

Thus the rows A-B, C-D, E-F, G-H, I-J and K-L when folded to the configuration of FIG. 8 each becomes a stack portion including many leaves of the overall sculpture in the round with each portion having multiple leaves with planar surfaces in face-to-face contact and the hinging means for supporting all these leaves relative to each other enable the planes of the planar face-to-faces surfaces to have their angular relationship changed as the structure is unfolded from the closed configuration of FIG. 8 to various open configurations and ultimately to assume the totally extended configuration of FIG. 9.

By creating a planar form in such a manner the leaves may be folded together to create a three-dimensional structure as described above. Where the planar structure is to be used as a game board, the three-dimensional structure may be designed with registering page apertures to define the walls of an internal recess 98 to accommodate playing pieces or other related accessories in the manner of the structure shown in FIG. 34. For example, a selected series of leaves in the sequence of leaves between leaves E and H may be so apertured with the leaves at both sides of the selected series forming the top and bottom of the internal recess. For maximum convenience in handling such accessories, a separate closed box structure 99 for use as a holder for playing pieces may be adhered to or otherwise attached to a face of one of the leaves as shown in cross section in FIG. 34 or may be completely removable from the structure. Alternatively, the respective face of such a leaf may be used in place of a side of such a box structure by attaching the edges of the remaining box walls directly thereto.

Generally square or rectangular leaves are well adapted to serve as an initial shape which is to be sculpted or extended and modified into related varied shapes. These leaves are then hinged or bound together at their edges. However, FIGS. 44 and 45 illustrate patterns of polygons which can also be adapted for use within the spirit of the present invention by providing hinges, folds or cuts at any line defined by the abutting edges of two of the polygons. For example, the dots on several lines in FIGS. 44 and 45 identify lines that are merely folded whereas the other internal lines of these figures are cut so that these structures may be progressively folded with leaves Tb and Hb each being the beginning leaf of a stack of leaves, and leaves Te and He being the respective ending leaves of the respective stacks of triangular and hexagonal structures. FIGS. 23–27 show ball shaped structures made from individual circular leaves. FIGS. 35–38 show three dimensional structures with a heart-like shape. Because such applications may require a leaf or leaves which have an edge or edges which are beveled or arcuate in cross section, it may be desirable to have the respective leaves molded from any moldable material, such as plastic or plastic foam. These additional shapes are illustrative of the variety of shapes possible.

Figure 35:
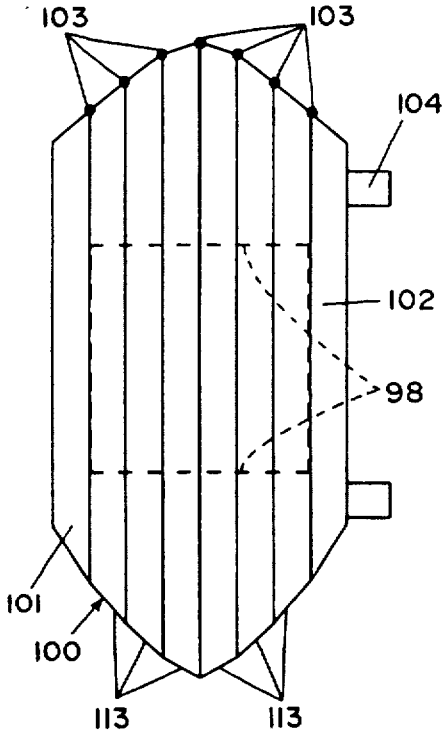
FIG. 35 is a side view of a structure comprised of multiple layers of single leaves in which all leaves except the outermost two are provided with aligning cutouts so that the interior of the three-dimensional structure is capable of serving as a closed compartment.
Figure 36:
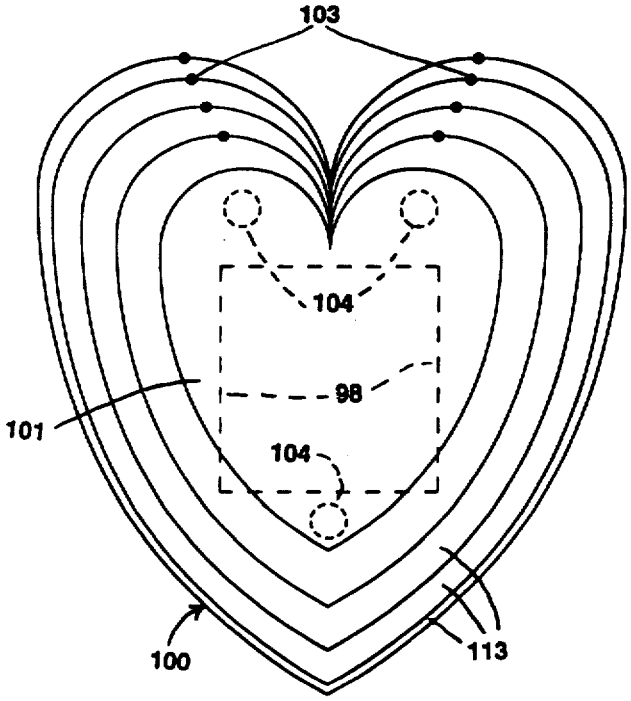
FIG. 36 is a plan view of the structure of FIG. 35.
Figure 35:
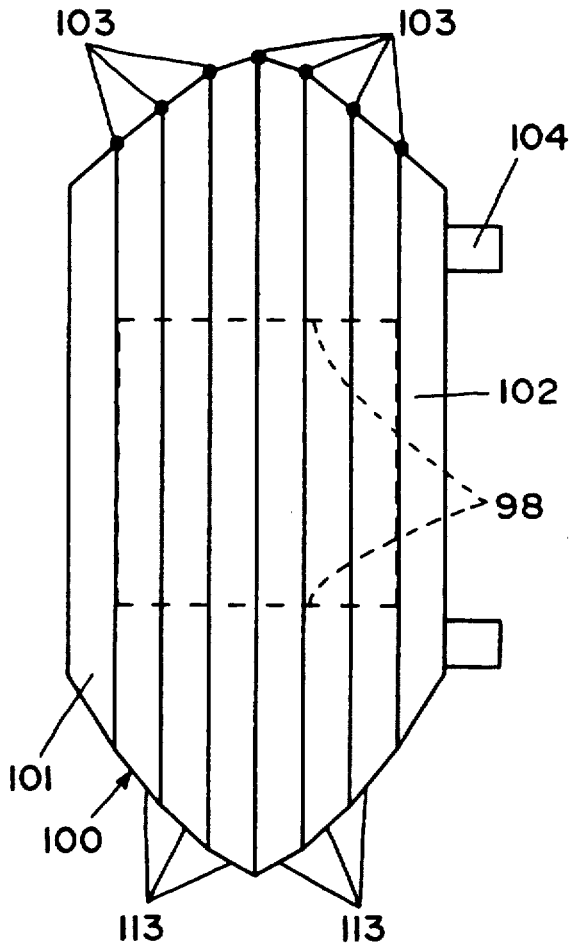
Figure 37:
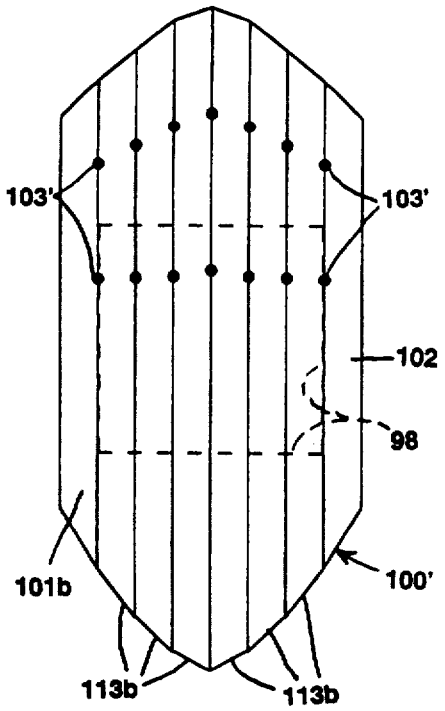
FIG. 37 is a side view of an embodiment similar to FIG. 35 in which each layer of the structure is comprised of symmetrical leaves hinging outwardly in opposite directions.
Figure 38:
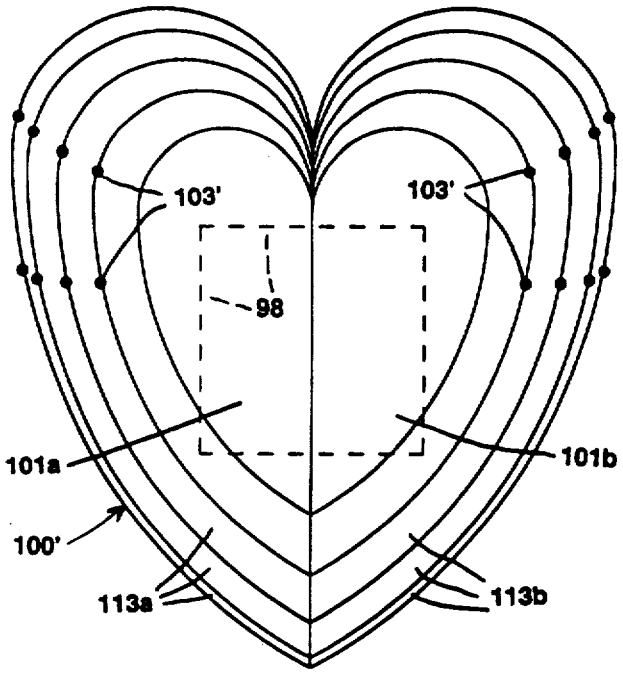
FIG. 38 is a plan view of the structure of FIG. 37.

In the heart-shaped sculptures in the round of FIGS. 35–38 the structures 100 are made with the intermediate leaves 113, **113*a* and 113*b* cut away to define the walls of an inner recess 98 as described previously. These structures differ primarily in that the structure of FIGS. 35–36 has pairs of spaced hinges 103 at the top of the heart as seen in FIG. 36 which interconnect the several heart-shaped leaves 101, 113 and 102, whereas the pairs of spaced hinge locations 103' are located along opposite sides of the leaves in the structures 100' of FIGS. 37–38 wherein all the leaves except for the back or base leaf 102 are cut down the center so that leaf portions 101*a* and 113*a* pivot outwardly to the left and leaf portions 101*b* and 113*b* pivot outwardly to the right as seen in FIG. 38. In the event that the outer face of base leaf 102 is curved, or if it is desired to support the sculpture in the round spaced from a flat surface, legs 104 as seen in FIGS. 35–36** may be attached to one face of the object.

In the binding illustrated in FIGS. 46–48, for a book which can be carved into a sculpture in the round, a multiplicity of interconnected leaves 13 are connected by means of a plurality of hinges 91, 92, 93 and 94 which are parts of structures, each of which includes a spine 90. The leaves as seen in FIGS. 46 and 48 are in their closed compact configuration and have concealed parallel surfaces. The leaves can be moved in sequence one at a time to expose hidden surfaces for reading. In FIG. 47 four of the six leaves are shown after being moved from the positions in FIG. 46, the movement being 90 degrees counterclockwise relative to the spine 90. The leaves have substantial thickness with sufficient stiffness so as not to bend during normal manipulation of the leaves of said sculpture with respect to each other. The spine structure is made relatively rigid by the spine portion 90 to retain the axes of the several hinges relative fixed and generally parallel to each other, i.e. perpendicular to the drawings of these figures. By means of the hinges and the structure of the hinged edge of each leaf which are essentially rigid right up to the hinge axis, the hinge structure allows for a respective leaf connected thereto to move essentially only pivotally with respect to the rigid spine portion. The spine structure is arranged so that the axes of said hinges are offset along a plane which is defined by the spine and which is inclined in the closed position at an acute angle with respect to the parallel concealed surfaces of the leaves. The hingedly interconnected leaves each have a flat edge portion lying along the rigid spine structure in the closed compact configuration. These flat edge portions cooperate with the spine structure to limit pivotal movement of the respective leaves to only one direction from their closed position. In FIGS. 46 and 47 the pivot axis for the hinge means for each leaf is approximately at the middle of the leaves along the intersection of two leaf edge surfaces which are beveled at approximately 45 degrees with respect to the outer parallel surfaces of the leaves. In FIG. 48 the parallel hinge axes are at the intersections of flat edge portions of the leaves beveled at 45 degrees and intersecting, and forming an acute angle with, the face of the respective leaf which faces the direction which the leaf pivots to open from its closed position.

As with several of the other drawings, FIGS. 46–48 are merely representative of certain structural features and do not depict the sculptured artistic characteristics which may be combined with the illustrated constructions. FIG. 48 avoids any groove at the hinges 93 and 94, which groove appears at the hinges 91 and 92 in the structure of FIG. 46, but both of these embodiments provide structures in which all external predominant surfaces of a cube-like configuration can be appropriately sculptured as long as rigidity or integrity of the spine is assured and adequate points of support for the leaves are provided along the hinge axis for each leaf.

Figure 17:
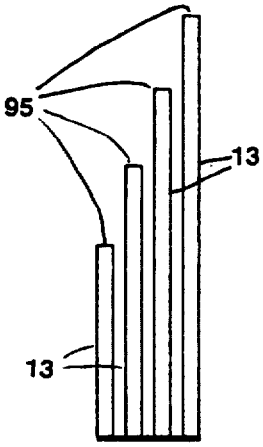
FIG. 17 is a side view of the leaves of a spine bound book in which each of the individual leaves has a typical square edge in cross section.
Figure 18:
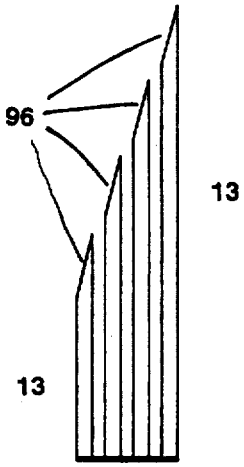
FIG. 18 is a side view corresponding to FIG. 17, but with the edge of each of the individual leaves angled or beveled in cross section.
Figure 19:
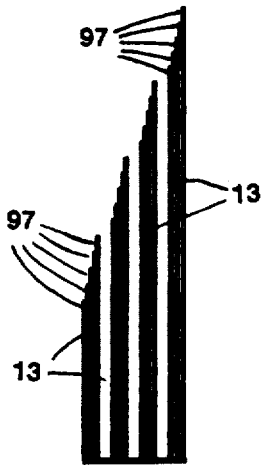
FIG. 19 is a side view of the leaves of a spine bound book in which each of the individual leaves is comprised of numerous thinner layers of varying shape or size.

The three-dimensional aspect of the present invention can be enhanced by combining a number of the different folding or interconnecting arrangements described herein. While using relatively thick leaves allows the greatest three-dimensional size variation, the use of square edged leaves as at 95 in FIG. 17 may leave a "stair-stepped" or jagged appearance in the final sculpture. This can be largely eliminated by shaping the edges of the various leaves to provide suitable beveled, concave or convex edge surfaces. Beveled edges are shown at 96 in FIG. 18. All of the intermediate leaves of the ball structures of FIGS. 24 and 25 have convex edges. As shown in FIG. 19, it is also possible to construct each leaf from a number of thinner layers 97 with squared edges but of gradually changing dimensions whose combined thickness equals the desired thickness and sculptured configuration of the leaf edges, which in FIG. 19 are beveled edges. A structure may also be comprised of a plurality of such thin layers, each layer being a separate leaf.

Other variations within the scope of this invention will be apparent from the described embodiment and it is intended that the present descriptions be illustrative of the inventive features encompassed by the appended claims.

What is claimed is:

1. A book-like structure having a closed configuration and various open configurations comprising a multiplicity of differently shaped individual leaves, each said leaf being essentially flat, wherein the shape of each said leaf is essentially defined in a single plane, said book structure having in its closed configuration a shape defined in three-dimensions forming a sculpture in the round, said three-dimensional shape comprising at least one portion of the overall sculpture in the round with each said portion having multiple leaves with planar surfaces in face to face contact, means for supporting the leaves relative to each other whereby the leaves in face to face contact are movable to change the angular relationship of the planes of said planar surfaces when the structure is changed from its closed configuration to various open configurations, said three dimensional shape being dependent on varying shapes or sizes of the individual leaves.

2. A book-like structure according to claim 1 wherein each said leaf has substantial thickness.

3. A book-like structure according to claim 1 wherein each said leaf is foldably attached to at least one other leaf.

4. A book-like structure according to claim 3 wherein the method of folding is a fan-fold method.

5. A book-like structure according to claim 3 wherein all the leaves are attached together along a common side.

6. A structure according to claim 3 wherein at least most of said leaves are capable of lying in a single plane when said structure is in an open configuration.

7. A structure according to claim 3 wherein all of said leaves are capable of lying in a single plane when said structure is in an open configuration.

8. A structure according to claim 7 wherein said leaves fill essentially all of a planar region when lying in said single plane.

9. A variable shape three dimensional object having at least a primary distinct compact three-dimensional configuration forming a sculpture in the round and a plurality of other configurations comprising a multiplicity of interconnected leaves of a plurality of contours, at least some of said leaves having sculptured portions whereby sculptured or other portions of said leaves define in one configuration compact three-dimensional configuration forming a sculpture in the round, said leaves having in said one compact configuration a plurality of surface portions with planar surfaces which are in face to face contact and hidden from view, means for supporting the leaves relative to each other whereby the leaves in face to face contact are movable to change the angular relationship of the planes of said planar surfaces when the structure is changed from its primary configuration to various other configurations, a plurality of said leaves being relatively movable to positions defining said plurality of other configurations, at least two different relatively movable hidden surface portions being exposed to view in each of said other configurations.

10. A sculpture in the round according to claim 9 wherein said contours are of a plurality of different sizes or a plurality of different shapes.

11. A sculpture in the round according to claim 10 constituting a book wherein at least some of said leaves have readable indicia on one or more of said normally-hidden surfaces.

12. A variable shape three-dimensional object according to claim 10 wherein all of said interconnected leaves are interconnected by a plurality of hinges each having a hinge axis parallel to faces of two leaves interconnected thereby.

13. A variable shape three-dimensional object according to claim 12 wherein said sculpture in the round has six predominant sides.

14. A variable shape three-dimensional object according to claim 12 wherein said sculpture in the round is a compact configuration with at least six predominant sides which include sides which are normally recognized as front, rear, top, bottom and two other opposite sides.

15. A variable shape three-dimensional object according to claim 14 wherein said hinges have axes which remain relatively oriented with their axes in a common direction in each of said configurations.

16. A variable shape three-dimensional object according to claim 14 wherein said hinges have axes which remain horizontal whenever said object in any of said configurations is placed on a horizontal surface.

17. A variable shape three-dimensional object according to claim 14 wherein when said bottom side is generally horizontal said hinges have axes which are generally vertical or perpendicular to said bottom side.

18. A variable shape three-dimensional object according to claim 12 wherein at least some hinges each join a respective pair of adjacent leaves which pair may assume a coplanar configuration and those adjacent leaves of that respective pair may relatively fold in only one direction from its coplanar configuration.

19. A variable shape three-dimensional object according to claim 12 wherein each hinge has a hinge axis, said object having in addition to said compact three-dimensional configuration forming a sculpture in the round an extended configuration achieved by moving esentially all of said leaves relative to each other.

20. A variable shape three-dimensional object according to claim 19 wherein relative directions of said hinge axes in both said compact configuration and extended configuration remain parallel to each other.

21. A variable shape three-dimensional object according to claim 19 wherein said hinge axes in said extended configuration are essentially coplanar.

22. A variable shape three-dimensional object according to claim 21 wherein the axes of at least many of the hinges are when in said compact configuration being arranged in at least two groups, the axes of one group being parallel to each other and oriented in a first direction and the axes of a second group being parallel to each other and oriented in a direction different from said direction.

23. A sculpture in the round according to claim 19 wherein when said sculpture in the round is unfolded to its extended configuration it has a leaf with a portion thereof cut away and another leaf has an edge portion projecting into said last mentioned leaf where it is cut away.

24. a variable shape three-dimensional object according to claim 12 wherein said hinges are part of a spine structure.

25. A variable shape three-dimensional object according to claim 24 wherein a plurality of said leaves extend generally in the same direction from the spine structure in said compact configuration.

26. A variable shape three-dimensional object according to claim 24 wherein said plurality of leaves when in said compact configuration are in two distinct groups extending from said spine, each group extending from said spine structure in a different direction.

27. A variable shape three-dimensional object according to claim 24 wherein said plurality of leaves when in said compact configuration are in two distinct groups extending from said spine structure in mutually opposite directions.

28. A variable shape three-dimensional object according to claim 24 having two spine portions movable relative to one another with a plurality of a different set of leaves connected to each of the two spine portions and said sets of leaves providing different distinct configurations of said three-dimensional object as said two spine portions are moved to different relative positions with respect to each portions are moved to different relative positions with respect to each other.

29. A variable shape three-dimensional object according to claim 24 wherein the axes of all said hinge always remain parallel to each other.

30. A sculpture in the round according to claim 12 wherein said compact configuration has a leaf with a portion thereof cut away and another leaf has an edge portion projecting through said last mentioned leaf where it is cut away.

31. A sculpture in the round according to claim 30 wherein the portion of the leaf which projects through the cut away leaf has a tight retaining frictional fit within an opening in the cut away leaf in the compact configuration.

32. A sculpture in the round according to claim 30 wherein the portion of the leaf which projects through the cut away leaf is interlocked with the latter in the compact configuration.

33. a sculpture in the round according to claim 12 wherein when said sculpture in the round is unfolded into its compact configuration it has a leaf with an edge portion thereof extending perpendicular to and overlying an edge portion of another leaf.

34. A sculpture in the round according to claim 33 wherein said overlying edge portion is interlocked with said edge portion which it overlies.

35. A variable shape three-dimensional object according to claim 10 wherein all of its leaves are permanently interconnected.

36. An object according to claim 9 wherein a plurality of its leaves are superposed in said compact configuration with at least some of the intermediate leaves of said superposed leaves being apertured to define peripheral portions of a closed compartment for retaining one or more small objects when the objects is in its compact configuration, at least one of said superposed leaves being moveable relative others of said superposed leaves to provide access to said compartment.

37. An object according to claim 36 wherein said compartment contains a small container.

38. An object according to claim 37 wherein said small container is detached from said object and is removable from said compartment when access thereto is provided.

39. An object according to claim 37 wherein said small container is formed by wall members which are secured to one of said superposed leaves which forms an end wall of said container and of said compartment.

40. An object according to claim 36 wherein in one of its other configurations the leaves are essentially coplanar to form a gameboard and said small objects are exposed for use on the gameboard.

41. A sculpture in the round according to claim 9 wherein said object comprises a stack of leaves hinged together in a succession and lying face to face in said stack in the compact configuration of said object, said stack having a series of successive hinges each of which is located at a different side of the stack from both any preceding and any succeeding hinge throughout the series.

42. A sculpture in the round according to claim 41 and further including means for holding the hinges of said stack of leaves together at one side of the stack while permitting relative separting movement of at least some adjacent leaves at the opposite side of the stack to inspect only one set of surfaces of the leaves.

43. A sculpture in the round according to claim 42 wherein the means for holding the stack together provides for changeably selecting the side of the stack along which it holds the stack hinges together to allow different sets of leaf surfaces to be inspected at different sides of the stack opposite the respective selected sides to be held.

44. A sculpture in the round according to claim 43 wherein said holding means comprises a C-shaped clamp structure with means for holding its ends inwardly against opposite sides of the stack to keep the stack from unfolding at all sides thereof.

45. A sculpture in the round according to claim 43 wherein said stack can be selectively held by the holding means at either of two opposite sides of the stack.

46. A sculpture in the round according to claim 43 wherein said stack can be selectively held by the holding means at any of more than two different sides of the stack.

47. A sculpture in the round according to claim 43 wherein said stack holding means comprises two straps each being attached at one end to a central area of an outer face of one outermost leaf of the stack, the straps being wrapped around opposite sides of the stack in said compact configuration with the other ends of said straps being attached to a central area of an outer face of an outermost leaf at the other end of the stack, said holding means being manipulatable whereby a first strap at one side of the stack is releaseable to allow leaves to be separated at said one side for inspection of a first set of leaf surfaces at said one side while the hinges at the opposite side of the stack are held together by a second strap remaining with both ends attached to said outer faces, and whereby said second strap at said opposite side of the stack is releasable to allow leaves to be separated at said opposite side for inspection of a second set of leaf surfaces at said opposite side while the hinges at said one side of the stack are held together by the first strap remaining with both ends attached to said outer faces.

48. A sculpture in the round according to claim 47 wherein said stack has multiple pairs of opposite sides whereby said straps may be attached to said outer faces to allows such separation of one or the other of sets of leaves at the opposite sides of different pairs of opposite sides.

49. A sculpture in the round according to claim 9 wherein said interconnected leaves are connected by a plurality of hinge means which are part of a spine structure, said leaves having concealed parallel surfaces when in said compact configuration ans substantial thickness with sufficient stiffness so as not to bend during normal manipulation of the leaves of said sculpture with respect to each other, said spine structure having a relatively rigid portion, each said hinge means allowing for a respective leaf connected thereto to move essentially only pivotally with respect to the rigid portion of the spine structure, said rigid portion of the spine structure being arranged so that the axes of said hinges are offset along a plane which is inclined at an acute angle with respect to said parallel surfaces.

50. A sculpture in the round according to claim 49 wherein said interconnected leaves each have a flat edge portion lying along the rigid portion of the spine structure in said compact configuration and cooperating with the spine structure to limit pivotal movement of the respective leaf to only one direction from its position in said compact configuration, the pivot axis for the hinge means for each leaf being along the intersection of the flat edge portion of the leaf and the face of the respective leaf which faces the direction which the leaf pivots from its position in said compact configuration.

51. A sculpture in the round according to claim 50 wherein in said compact configuration the flat edge portions of said interconnected leaves and the plane of said axes are parallel and at an angle of 45 degrees with respect to said concealed parallel leaf surfaces.

52. A three dimensional sculpture in the round comprising a plurality of leaves of different sizes or shapes, said sculpture having a base structure to support it on a flat horizontal surface, said leaves being interconnected and having one relatively fixed relationship in which they define a unique compact three-dimensional configuration forming said sculpture in the round, said sculpture being convered at its outer side in said compact configuration by portions of at least two of said leaves, said compact configuration having a central portion comprising a stack of many different generally parallel leaves having planar surfaces in face to face contact, each leaf having at least one normally-hidden surface portion, means for supporting the leaves of said stack so that they are relatively moveable to change the angular relationship of the planes of said planar surfaces to permit inspection of each of said normally-hidden surface portions.

53. A sculpture in the round according to claim 52 wherein said base structure is a generally flat surface formed by portions of at least one leaf.

54. A sculpture in the round according to claim 52 wherein said base structure is formed by a plurality of legs extending from one or more leaves of the sculpture in the round.

55. A sculpture in the round according to claim 52 wherein said base structure is formed by edge portions of at least two leaves of the sculpture in the round.

56. A sculpture in the round according to claim 52 constituting a book wherein at least some of said leaves have readable indicia on one or more of said normally-hidden surfaces.

57. A sculpture in the round according to claim 52 wherein said leaves are interconnected by a plurality of hinges.

58. A book-like structure having a closed compact configuration and a plurality of open reading configurations, said structure comprising a multiplicity of individual leaves, leaf supporting means interconnecting said leaves, each said leaf having at least one essentially flat surfaces and having substantial thickness, the contour of each said leaf being essentially defined in a single plane, said book structure having in its closed configuration a shape defined in three-dimensions forming a sculpture in the round, said three-dimensional shape being dependent on varying contours of at least two edges of many of the individual leaves, said leaf-supporting structure permitting relative movement to different positions of a stack of many of the leaves so that in certaain positions flat indicia bearing surfaces of many leaves in the stack are exposed and in other positions those indicia bearing surfaces are concealed by other leaves of the stack in face to face contact therewith, the leaf supporting means providing successive supporting locations for all the leaves in the stack, which supporting locations lie along a locus having a continuous path.

59. A book-like structure according to claim 58 wherein said leaf supporting structure comprises at least one member penetrating a stack of many leaves of the structure.

60. A book-like structure according to claim 59 wherein each such penetrating member is a rigid member.

61. A book-like structure according to claim 60 wherein said rigid member has a fixed length and leaves are swingable parallel to their respective flat surfaces.

62. A book-like structure according to claim 60 wherein said rigid member is an endless loop.

63. A book-like structure according to claim 59 wherein each such penetrating member is a flexible member.

64. A book-like structure according to claim 59 wherein each such penetrating member is an elatic member.

* * * * *